US007127201B2

(12) United States Patent
Takenouchi et al.

(10) Patent No.: US 7,127,201 B2
(45) Date of Patent: Oct. 24, 2006

(54) IMAGE FORMING APPARATUS AND IMAGE FORMING METHOD

(75) Inventors: Shigeki Takenouchi, Chofu (JP); Masao Asano, Tokyo (JP); Tomoe Kitani, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 79 days.

(21) Appl. No.: 11/008,607

(22) Filed: Dec. 9, 2004

(65) Prior Publication Data

US 2005/0135844 A1 Jun. 23, 2005

(30) Foreign Application Priority Data

Dec. 12, 2003 (JP) ..... 2003-414414

(51) Int. Cl.
*G03G 15/16* (2006.01)
*G03G 21/00* (2006.01)

(52) U.S. Cl. ..... 399/297; 399/101; 399/350

(58) Field of Classification Search ..... 399/99, 399/101, 297, 302, 350; 430/120, 124, 106.1, 430/108.4

See application file for complete search history.

(56) References Cited

U.S. PATENT DOCUMENTS 4,901,110 A * 2/1990 Tompkins et al. ..... 399/302
5,753,396 A 5/1998 Nakamura et al.
6,465,144 B1 * 10/2002 Hashimoto et al. ..... 430/106.1

FOREIGN PATENT DOCUMENTS

| | | |
|---|---|---|
| JP | 63-56658 | 3/1988 |
| JP | 5-181291 | 7/1993 |
| JP | 6-332324 | 12/1994 |
| JP | 6-337598 | 12/1994 |
| JP | 7-271142 | 10/1995 |
| JP | 8-305074 | 11/1996 |
| JP | 11-202539 | 7/1999 |
| JP | 2002-162839 | 6/2002 |
| JP | 2002-278319 | 9/2002 |
| JP | 2003-302781 | 10/2003 |
| JP | 2003-316064 | 11/2003 |

OTHER PUBLICATIONS

Notice of Reason for Rejection for Japanese Patent Application No. 2003-414414 dated Jun. 20, 2006 with English translation.

* cited by examiner

*Primary Examiner*—Hoang Ngo
(74) *Attorney, Agent, or Firm*—Cantor Colburn LLP

(57) ABSTRACT

An image forming apparatus comprising a plurality of image forming units, an intermediate transfer member, and an intermediate transfer member cleaning device to remove toner remaining the intermediate transfer member with plural cleaning blades, wherein each color toner used in the developing device of the plurality of image forming units contains 10 number % or less of toner particles whose diameter is (0.7×50% number particles diameter (Dp50)) or less and contains 300 ppm or less of a remaining monomers is disclosed.

20 Claims, 3 Drawing Sheets

FIG. 2 ( a )
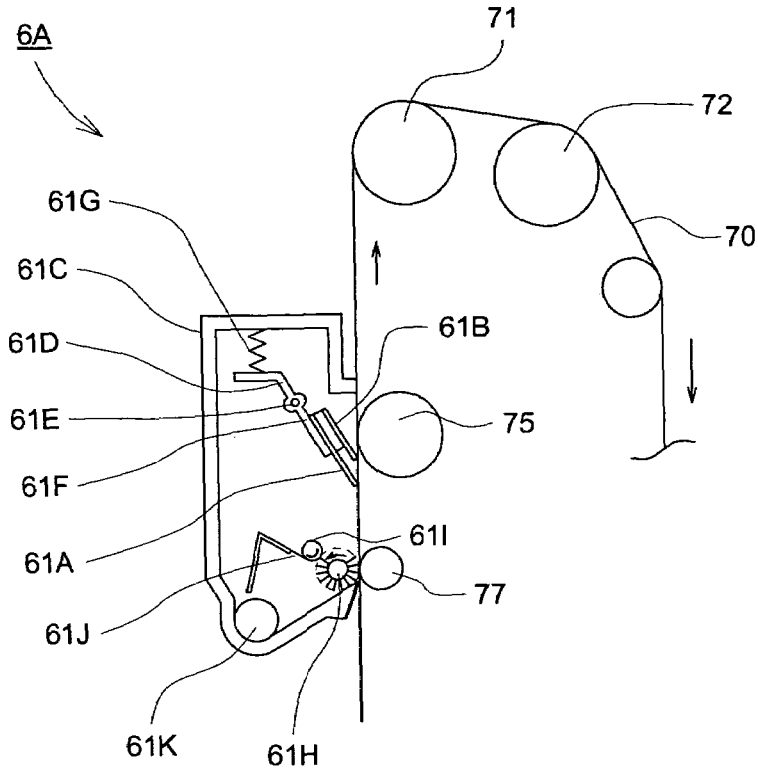
FIG. 2 ( b )
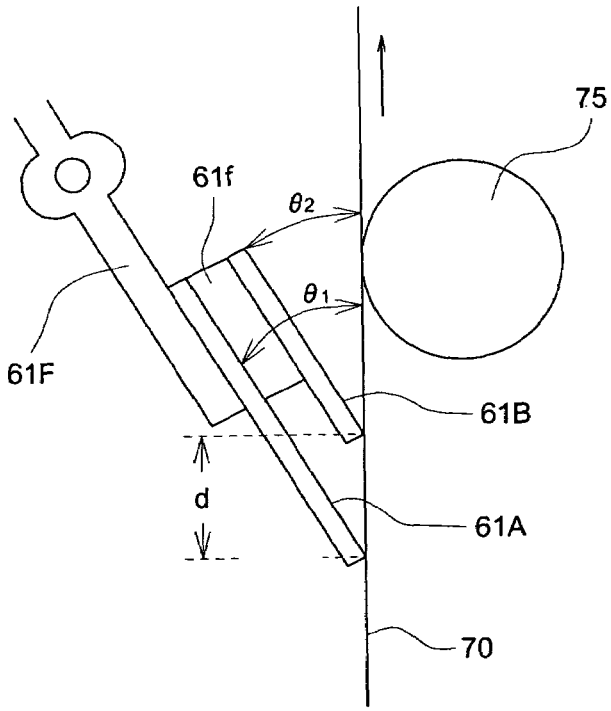

IMAGE FORMING APPARATUS AND IMAGE FORMING METHOD

BACKGROUND

1. Field of the Invention

The present invention relates to an imaging forming apparatus used as an electrophotographic color copier and a color printer and an image forming method using the image forming apparatus.

2. Related Art

Even in a color copier and a color printer, a strong tendency to color images is seen lately. The color image forming methods, which are valuable for practical use, are broadly classified by generally used popular names into the intermediate transfer method, the KNC method (a method for forming a multi-color superimposed image on an electrophotographic photoconductor and transferring it in a batch), and the tandem method.

Although these are of course popular names given from different viewpoints, for example, there is naturally a method which is the intermediate transfer method and also the tandem method. A color image forming apparatus of the intermediate transfer method and the tandem method (hereinafter, the tandem method is referred to as the method which is the intermediate transfer method and also the tandem method) is known as a one for producing full color images of high quality. This method forms toner images on the respective electrophotographic photoconductors (hereinafter, referred to as just photoconductors) corresponding to the colors of yellow, magenta, cyan, and black, forms a color superimposed image on an intermediate transfer medium, and transfers it onto a transfer material in a batch.

In the color image forming by the tandem method, there are transfer steps of two stages of primary transfer of transferring toner images from each photoconductor to the intermediate transfer medium and secondary transfer of transferring the toner images from the intermediate transfer medium to a recording paper, and there are two stages of cleaning such as cleaning of the photoconductors after the primary transfer and cleaning of the intermediate transfer medium after the secondary transfer, so that defective images due to defective transfer of toner images or defective images due to cleaning are often apt to be formed.

In the image forming apparatus using the intermediate transfer medium, to avoid enlargement of the apparatus, a method adopting a belt-shaped intermediate transfer medium capable of realizing miniaturization of the apparatus is often used. However, in cleaning of the belt-shaped intermediate transfer medium, the contact status of a cleaning member with the intermediate transfer medium is apt to be changed and defective cleaning is easily caused. To solve the defective cleaning of the intermediate transfer medium, several proposals have been made. For example, a method which uses a cleaning device (Japanese Patent Application 2002-162839) with a cleaning blade adhered to a thin metallic plate member or a cleaning device (Japanese Patent Application 2002-278319) using a cleaning blade and a metallic scraper and removes residual toner on the intermediate transfer medium has been proposed.

However, when in the particle size distribution of toner of a developer, a large amount of toner component of fine particles with a diameter of 1 μm or so is contained, the fine particle toner component is easily adhered to the surfaces of the photoconductor and intermediate transfer medium and defective transfer and cleaning are easily generated from the photoconductor or intermediate transfer medium. Particularly, when fine particle toner is adhered to an intermediate transfer medium having small surface wear, partial toner filming occurs on the intermediate transfer medium, and the toner filming part becomes unstable in the contact wear with the cleaning member, and even if the aforementioned cleaning device using a cleaning blade and a metallic scraper is used, the intermediate transfer medium cannot be cleaned sufficiently, and toner easily passes through the cleaning blade, and as a result, image defects such as uneven images are easily caused.

Further, in defective transfer of toner from the photoconductor to the intermediate transfer medium, image defects such as reduction in the image density and missed transfer are easily caused. On the other hand, in defective transfer of toner from the intermediate transfer medium to a recording paper, scattered letters due to flicked transfer and reduction in sharpness are reported.

To improve the transferability causing "missed transfer" and "scattered letters", the arts of making the surface layer of an electrophotographic photoconductor contain fine particles, making the surface uneven, reducing the adhesive force of toner on the surface of the photoconductor, improving the transferability, and reducing the frictional force with the blade have been examined. For example, it is reported that a photosensitive layer contains fine particles of alkylsilsesquioxane resin (Japanese Patent Application 5-181291). However, fine particles of alkylsilsesquioxane resin is hygroscopic, and the wettability of the surface of the photoconductor, that is, the surface energy is increased in a high humidity environment, so that a problem arises that the transferability is apt to reduce. On the other hand, to reduce the surface energy of the photoconductor, an electrophotographic conductor containing fluorine plastic powder is reported. However, sufficient surface strength cannot be obtained by fluorine plastic powder, and a streak fault caused by a scratch of the photoconductor surface is easily generated, so that a problem arises that image diffusion is easily caused (Japanese Patent Application 63-56658).

On the other hand, to improve the transferability of the intermediate transfer medium and the cleaning performance, an art of supplying a solid lubricant to the intermediate transfer medium and reducing the surface energy of the intermediate transfer medium is published (Japanese Patent Application 6-337598, Japanese Patent Application 6-332324, Japanese Patent Application 7-271142). However, only such control for the surface of the intermediate transfer medium is not sufficient for improvement of the total transferability of the image forming method using the intermediate transfer medium having the two transfer steps and particularly for copy image forming at high temperature and high humidity or over a long period of time, it is found that further improvement is necessary.

On the other hand, taking notice of the electrophotographic process, the latent image forming method is broadly classified into analog image forming using a halogen lamp as a light source and image forming of a digital method using an LED or a laser as a light source. In recent years, as a printer of a personal computer or even in an ordinary copier, from easy image processing and easy development to a copier, the latent image forming method of the digital method is suddenly used predominantly.

In image forming of the digital method, the use method for not only copying an image but also forming an original image is increased and in electrophotographic image forming of the digital method, a tendency to high image quality is seen.

For the aforementioned request for realization of high image quality, a study of faithfully developing a latent image on an electrophotographic conductor has been made using polymerized toner controlling the shape factor and particle size distribution. However, when the polymerized toner is used for a color image forming apparatus of the tandem method, improvement of the toner transferability and improvement of the cleaning performance are not realized so much as expected at first and image defects due to defective transfer and passing of toner due to defective cleaning are easily caused.

Particularly, in the color image forming apparatus of the tandem method using the intermediate transfer medium, it is found that improvement of the total toner transferability of the aforementioned primary transfer and secondary transfer and improvement of the cleaning performance of the intermediate transfer medium are important.

A main object of the present invention, with the foregoing problems in view, is to provide an image forming apparatus and an image forming method using a useful intermediate transfer medium. Further, another object of the present invention viewed from one aspect is to provide good electrophotographic color images using an image forming apparatus using an intermediate transfer medium and to provide an image forming apparatus of an electrophotographic method and an image forming method, particularly in forming a large number of color images, capable of improving the transferability from a photoconductor to an intermediate transfer medium, the transferability from the intermediate transfer medium to a recording material, and the removability of the residual toner component on the intermediate transfer medium, thereby preventing missed transfer and scattered letters due to defective transfer or uneven images due to defective cleaning, and reproducing color images of good sharpness and a clear hue. Still another object is to provide an image forming apparatus of an electrophotographic method and an image forming method, particularly using a belt-shaped intermediate transfer medium, capable of preventing uneven images due to defective cleaning easily caused by the intermediate transfer medium and missed transfer and scattered letters due to defective transfer and reproducing color images of good sharpness and a clear hue.

SUMMARY OF THE INVENTION

In the first aspect, in an image forming apparatus provided with a plurality of image formation units which have at least an electrophotography photoreceptor, a charging device, an exposure device, a developing device, a transferring device, and a cleaning device, an intermediate transfer member, and a cleaning device for intermediate transfer member to remove toner remaining on the above-mentioned intermediate transfer member by plural cleaning blades, each color toner image formed on an electrophotographic photoreceptor by the use of toner whose color is changed for each of the plurality of image forming units is sequentially transferred and superimposed so as to form a color toner image on an intermediate transfer member, the color toner image is collectively re-transferred on a recording material, and the re-transferred color toner image is fixed to form a color image, the content of toner particles having a particle size below 0.7×(Dp50) in each color toner used for the developing device of the plurality of the image formation units is 10 number % or less, and the amount of remaining monomers contained in each color toner is 300 ppm or less.

In the second aspect, in an image forming method in which each color toner image formed on an electrophotographic photoreceptor by the use of toner whose color is changed for each of the plurality of image forming units is sequentially transferred and superimposed so as to form a color toner image on an intermediate transfer member, the content of toner particles having a particle size below 0.7×(Dp50) in each color toner used for the developing device of the plurality of the image formation units is 10 number % or less, and the amount of remaining monomers contained in each color toner is 300 ppm or less, the color toner image is transferred at one time onto a recording material; the retransferred color toner image is fixed on the recording material so as to form a color image, toner remaining the intermediate transfer member is removed with plural cleaning blades of an intermediate transfer member cleaning device.

BRIEF DESCRIPTION OF THE DRAWINGS

FIGS. 2(*a*) and 2(*b*) each is a drawing showing an example of the cleaning device for the intermediate transfer medium.

DETAIL DESCRIPTION OF THE EXEMPLARY EMBODIMENTS

Figure 1:
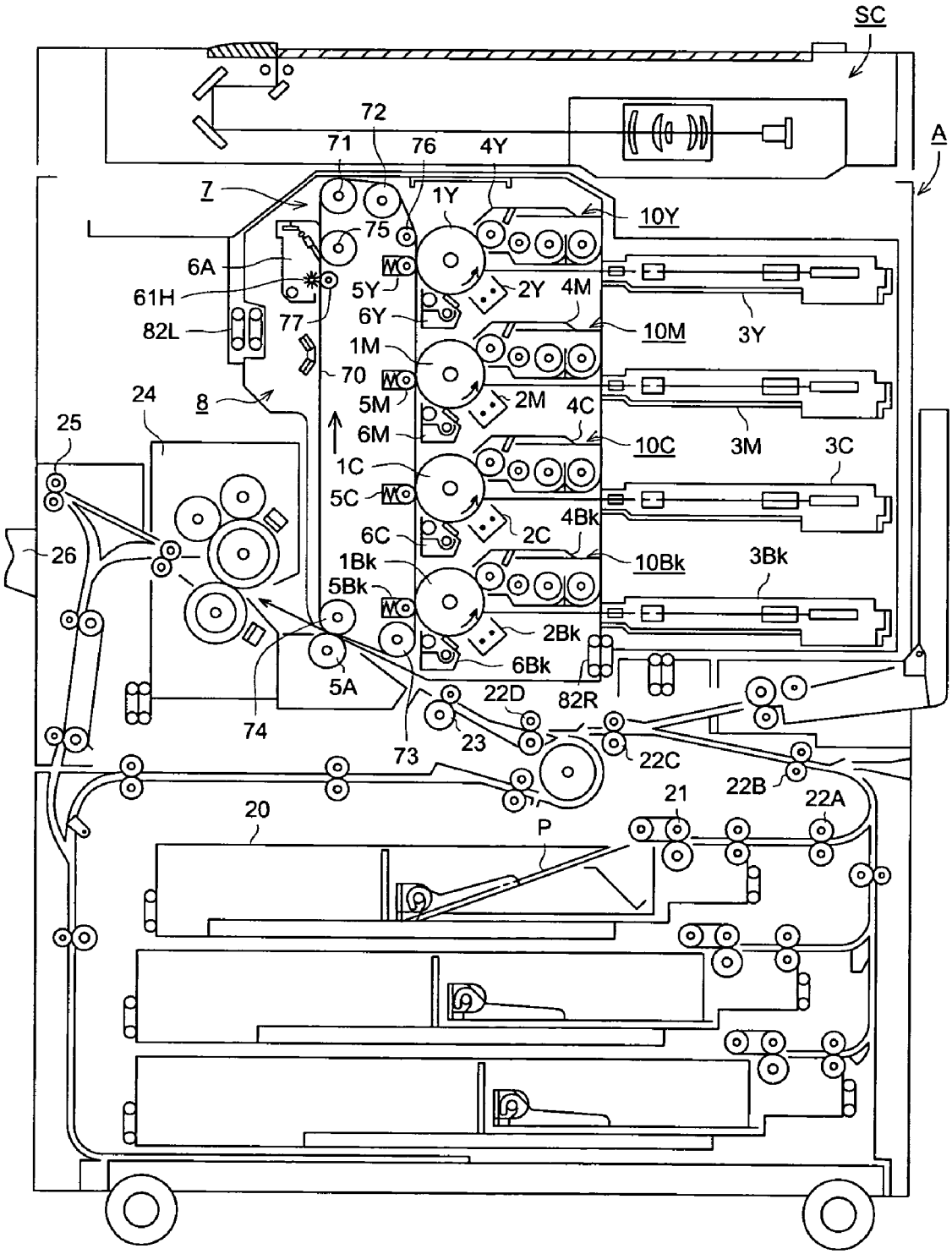
FIG. 1 is a cross sectional schematic view of the color image forming apparatus indicating an embodiment of the present invention.

The inventors examined in detail, in an image forming apparatus for forming color images using an intermediate transfer medium, the primary transferability of a color toner image from a photoconductor to the intermediate transfer medium, the secondary transferability of toner images of various colors superimposed on the intermediate transfer medium to a recording paper, and the cleaning performance for toner on the photoconductor and intermediate transfer medium and as a result of it, found that in the particle size distribution of each color toner, the amount of toner of fine particles takes part in the deterioration of the primary transferability, secondary transferability, and cleaning performance for the intermediate transfer medium. Namely, the inventors found that toner of fine particles is easily adhered to the surfaces of the photoconductor and intermediate transfer medium, particularly to the surface of an intermediate transfer medium of small surface wear, and when such toner of fine particles is adhered to the surface of the intermediate transfer medium, the primary transferability and secondary transferability of toner images are reduced, and the cleaning performance for toner on the intermediate transfer medium is deteriorated, thus uneven images are caused.

Namely, the inventors found that to improve the primary transferability and secondary transferability of toner of each color and keep the cleaning performance for toner on the intermediate transfer medium in a satisfactory status, by reducing the amount of toner of fine particles contained in toner of each color and the amount of residual monomer to fixed values or smaller and forming the cleaning means for the intermediate transfer medium by a plurality of cleaning blades, the transferability and cleaning performance can be improved.

To the above-mentioned matter, the following structures are effective.

In an image forming apparatus in which a plurality of image formation units each which have at least an electrophotography photoreceptor, a charging measure, a light exposure measure, a developing measure, a transfer measure, and a cleaning measure are arranged, each color toner image formed on an electrophotographic photoreceptor by the use of toner whose color is changed for each of the plurality of image forming units is sequentially transferred and superimposed so as to form a color toner image on an intermediate transfer member, the color toner image is collectively re-transferred on a recording material, and the re-transferred color toner image is fixed to form a color image, the image forming apparatus is characterized in that the content of toner particles having a particle size below 0.7×(Dp50) in each color toner used for the developing means of the plurality of the image formation units is 10 number % or less, and the amount of remaining monomers contained in each color toner is 300 ppm or less, the image formation apparatus has a cleaning means for the intermediate transfer members to remove the toner remaining on the intermediate transfer member by plural cleaning blades.

With such the structure, an improvement of a toner transfer characteristic of an electrophotographic method with the use of an intermediate transfer member can be achieved, an image defect such as lacking of partial toner image and scattering of character image caused by the lowering of toner transfer can be prevented, and, an image formation apparatus and an image forming method of an electro photographic type which can form a good color picture image in terms of an image density and sharpness, can be offered.

Hereinafter, the present invention will be explained more in detail.

As toner of each developing means, by using toner in which the content of toner particles having a particle diameter below 0.7×50% number particle diameter (Dp50) is 10 number % or less, and the amount of remaining monomers contained in each color toner is 300 ppm or less, the transferring ability of a color toner image superimposed on the intermediate transfer member to the recording sheet is improved significantly, and the remaining toner on the intermediate transfer member after the toner image transfer is removed using a cleaning means having plural cleaning blades, whereby the cleaning for the intermediate transfer member is performed well stably, an imperfect transfer by the transfer of twice and character image scattering can be prevented, and image unevenness due to a cleaning ability of toner on the intermediate transfer member etc. is remarkably improvable, a color image in which sharpness is good and tone is vivid can be formed.

Moreover, as toner of each developing means, by using toner in which the ratio (Dv50/Dp50) of toner particles of 50% volume particle diameter (Dv50) and 50% number particle diameter (Dp50) are 1.0–1.15, the ratio (Dv75/Dp75) of a cumulative 75% volume particle diameter (Dv75) from the largest particle diameter on the volume basis and a cumulative 75% number particle diameter (Dp75) from the largest particle diameter on the number basis is 1.0–1.20, and the content of toner particles having a particle diameter below 0.7×(Dp50) is 10 number % or less and the amount of remaining monomers contained in each color toner is 300 ppm or less, the transferring ability of a color toner image superimposed on the intermediate transfer member to the recording sheet is improved significantly, and the remaining toner on the intermediate transfer member after the toner image transfer is removed using a cleaning means having plural cleaning blades, whereby the cleaning for the intermediate transfer member is performed well stably, an imperfect transfer by the transfer of twice and character image scattering can be prevented, and image unevenness due to a cleaning ability of toner on the intermediate transfer member etc. is remarkably improvable, a color image in which sharpness is good and tone is vivid can be formed.

As toner used for a present invention, polymerized toner is desirable. The polymerized toner in which the content of toner particles having a particle diameter below 0.7×(Dp50) is 10 number % or less and the amount of remaining monomers contained in each color toner is 300 ppm or less, cannot pollute the surface of an organic photoreceptor or an intermediate transfer member easily, and does not generate a poor transfer and a cleaning failure easily. Especially, if there are many remaining monomers, it will be easy to generate the character image scattering and an imperfect transfer at the time of a toner transfer, and the cleaning ability of the remaining toner on an intermediate transfer member will also tend to deteriorate. The amount of remaining monomers is 150 ppm or less more preferably, and is 50 ppm or less most preferably.

Here, polymerized toner means the toner in which the production of resin of binder for toner and the toner form are formed by polymerization of the raw material monomer of binder resin and a subsequent chemical treatment conducted as necessity. More concretely, it means the toner formed through polymerization reactions such as suspension polymerization and emulsion polymerization and fusion process of the particles performed after that as occasion demands.

Although the amount of remaining monomers in polymerized toner changes with the polymerization condition of polymerized toner, As the method of reducing the final amount of remaining monomers, a method of using two kinds of chain transfer agents described in the official gazette of TOKUGAN No. 2000-117411, a method of removing the remaining monomers by vacuum distillation described in the official gazette of TOKKAIHEI No. 11-202539, and a method of lengthening the half-life of a polymerization initiator (by lowering the reaction temperature) are listed up.

About measurement of the remaining monomers of toner, by the gas chromatograph of a head space method, the remaining monomers of toner can be measured using the detection method used by the usual gas chromatographs, such as an internal standard method. The method measures the amount of volatilization compositions in such a way that toner is enclosed into an opening-and-closing container, warmed to a temperature at the time of heat fusing, such as a copying machine, and on the condition that volatilization compositions has been full into a container, the gas in the container is promptly injected into a gas chromatograph, And, the method also performs MS (mass spectroscopy).

In the above-mentioned head space method, it makes possible to observe all the peaks of a volatilization compositions by a gas chromatograph, also quantification of remaining compositions can be attained in more advanced accuracy by using the method of analysis utilizing a electromagnetic interaction.

Hereinafter, the measuring method of the amount of remaining monomers is explained.

<The Head Space Gas-chromatography-measurement Method>

1. Pick-up of a Sample

A 0.8 g sample is picked to a vial for 20 ml head spaces. The weighing of the amount of samples is carried out to 0.01 g (required to calculate the area per unit mass). The seal of the vial is carried out using septum with the use of an exclusive clipper.

2. Warming of a Sample

The sample is put into a 130° C. temperature controlled bath on the state that it keeps standing, and it is warmed for 30 minutes.

3. Setting of Gas Chromatograph Separation Condition

A column with an inside diameter of 3 mm and a length of 3 m in which a carrier coated with silicone oil SE-30 to become 15% by a mass ratio is filled up is used as a separation column. The separation column is loaded on a gas chromatograph, Helium He is made to flow at 50 ml/minutes as a carrier. The temperature of a separation column is made into 40° C., and it is measured while the temperature is raised to 260° C. at 15° C./minutes.

It holds for 5 minutes after arrival at 260° C.

4. Introduction of Sample

Immediately after the vial bin is taken out from the temperature controlled bath, 1 ml of gas generated from the sample in the gas-tight syringe is extracted, and this sample is injected into the above-mentioned separation column.

5. Calculation

An analytical curve is beforehand prepared using xylene as an internal reference substance, and the concentration of each composition is obtained, respectively.

6. Instruments and Materials (1) Head Space Condition

Head space apparatus

HP7694 "HEAD SPACE SAMPLER" by Hewlett Packard Co.

Temperature conditions

Transfer line: 200° C.

Loop temperature: 200° C.

Amount of samples: 0.8 g/20 ml vial (2) GC/MS Condition

GC HP5890 by Hewlett Packard Co.

MS HP5971 by Hewlett Packard Co.

Column: H.P.-624 30 m×0.25 mm

Oven temperature: 40° C. (3 min)-15° C./min-260° C.

Measuring mode: SIM

The production method of the toner is described below.

The present inventors examined earnestly problems of the image formation apparatus of an intermediate transfer member method using small diameter toner whose average particle diameter is 3 μm–8 μm.

As a result, the inventor found that with only small diameter-sized toner, remaining toner on an intermediate transfer member is not sufficiently removed, and picture image unevenness based on the above mentioned poor transfer and the above mentioned cleaning failure etc. may be easily occurred.

The present inventor and so on found that by placing a view point on 50% particle diameter which is the medium value of toner particle diameter in all toner, 50% number particle diameter of toner particles is set to Dp50, if small particle diameter compositions which has deviated from the Dp50 greatly exists in large quantities in toner, monomer components which remains in such fine particle diameter toner tends to adhere to a photoreceptor or an intermediate transfer member, the above-mentioned twice transferring ability of toner and the cleaning ability of toner on an intermediate transfer member tend to become problems, image faults based on poor transfer and cleaning failure, such as an imperfect transfer and picture image unevenness tends to occur. Further, they found that it is effective to make the amount of remaining monomers in toner to 300 ppm or less and, simultaneously, to use the toner which is made to contain a small amount of the following minute toner composition.

Namely, each color toner used for the developing means of the image formation unit used for the image formation apparatus using the above mentioned intermediate transfer member has the amount of remaining monomers of 300 ppm or less. Simultaneously, in each color toner, the content of the toner particles whose particle diameters are below 0.7× 50% number particle diameters (Dp50) is ten or less number %, whereby the transferring ability of toner on a photoreceptor or an intermediate transfer member can be improved. In addition, by using plural cleaning blades for the cleaning means of an intermediate transfer member, the cleaning ability of an intermediate transfer member can be improvable.

Further, the ratios (Dv50/Dp50) of toner particles of 50% volume particle diameter (Dv50) and 50% number particle diameter (Dp50) are 1.0–1.15, the ratios (Dv75/Dp75) of a cumulative 75% volume particle diameter (Dv75) from the largest particle diameter on the volume basis and a cumulative 75% number particle diameter (Dp75) from the largest particle diameter on the number basis is 1.0–1.20, the content of toner particles having a particle diameter below 0.7×(Dp50) is 10 number % or less in all toner, and by using a cleaning means to have plural cleaning blades as a cleaning means of an intermediate transfer member, transferring ability and cleaning ability can be improved and a sharp electro-photographic image can be formed.

Firstly, with regard to toner according to the present invention, 50% volume particle diameter (Dv50), 50% number particle diameter (Dp50), the ratio of 50% volume particle diameter (Dv50) and 50% number particle diameter (Dp50) and the ratio (Dv75/Dp75) of a cumulative 75% volume particle diameter (Dv75) and 75% number particle diameter (Dp75) are explained.

The toner of the present invention needs to make the toner compositions of a minute particle diameter below a predetermined value. Namely, in all toner, if 50% number particle diameter of toner particles is set to Dp50, it is required for the number of the toner whose particle diameter is below 0.7×(Dp50) to be ten number % or less. More desirably, the numbers of the toner whose particle diameter is below 0.7×(Dp50) are 5 number %–8 number %. Here, 50% number particle diameter in the present invention means the particle diameter (it is also called median diameter on number basis) at 50% on an addition distribution curve on number basis.

Further, from a viewpoint which acquires the effect described in the present invention, it is desirable that the grain size distribution of toner is single homogenization, and it is desirable that the ratio (Dv50/Dp50) of 50% volume particle diameter (Dv50) and 50% number particle diameter (Dp50) is 1.0–1.15, furthermore, it is desirable that it is 0.1.0–1.13. Here, 50% volume particle diameter in the present invention means the particle diameter (it is also called median diameter on volume basis) at 50% on an addition distribution curve on volume basis.

Further, in order to control the variation range of transferability as well as developability, the ratio (Dv75/Dp75) of the cumulative 75 percent volume particle diameter (Dv75) from the largest particle diameter to the cumulative 75 percent number particle diameter (Dp75) from the largest particle diameter is preferable to be from 1.0 to 1.20, and is more preferably from 1.1 to 1.19.

Further, the 50 percent volume particle diameter (Dv50) of the toner according to the invention is preferably from 3 μm to 8 μm, and is more preferably from 3 μm to 7 μm. Further, the 50 percent number particle diameter (Dp50) of the toner according to the invention is preferably from 2 to 7.5 μm, and is more preferably from 2.5 to 7 μm. By adjusting said diameter to said range, the effects of the preset invention are more markedly exhibited.

The cumulative 75 percent volume particle diameter (Dv75) or the cumulative 75 percent number particle diameter (Dp75), as described herein, refers to the volume particle diameter or the number particle diameter, each of which is 75 percent with respect to the sum of the total volume or the sum of the total number while accumulating the frequency from the largest particle diameter.

In the present invention, 50% volume particle diameter (Dv50), 50% number particle diameter (Dp50), the cumulative 75% volume particle diameter (Dv75), the cumulative 75% number particle diameter (Dp75), etc. are measured and calculated by the use of an apparatus in which the computer systems for processing data (made by the Beckmann Coulter Company) is connected to COULTER MULTISIZER II (made by the Beckmann coulter company).

As the process of measurement, after adding and stirring Toner 0.02 g in 20 ml of 1% aqueous solutions produced with surfactants (for example, EMAL E-27C (made by Kao Corp.) etc.) and pure water, an ultrasonic transfer is performed for 1 minute and sample dispersion liquid is produced. This sample dispersion liquid was poured into the beaker containing ISPTONII in a sample stand (made by the Beckmann coulter company) with the pipette until it became measurement concentration 10–12%, and the measuring-instrument count was set as 30000 pieces and measured. Incidentally, the diameter of 100 μm diameter was used as a diameter of an aperture of a Coulter Multi-SAIZA.

Incidentally, if the same measurement numerical value as the above-mentioned measuring device system is acquired, it will not interfere to use other measuring devices.

The constituting components of toner and the components of binding resins which constitute said toner, as well as those of these production, will now be described.

Although the toner according to the present invention contains at least a colorant, a binder resin, etc. The above-mentioned toner may be manufactured through a pulverization and classification process, also it may be manufactured by the so-called polymerizing method which produces toner using resin particles which are obtained by polymerizing polymerizable monomer as shown below. When manufacturing toner using the polymerizing method, a production method that has a process to conduct salting-out/fusing resin particles is especially desirable.

Polymerizable monomers employed in the polymerization method comprise radical polymerizable monomers as a component, and if desired, crosslinking agents may be employed. Further, it is preferable that at least one of said radical polymerizable monomers, having an acidic group or a basic group shown below, is incorporated.

(1) Radical Polymerizable Monomer Component

Radical polymerizable monomer components are not particularly limited and several of the conventional radical polymerizable monomers may be employed. The monomer may be employed solely or in combination of two or more kinds thereof for satisfying required properties.

In concrete, aromatic mono-vinyl type monomers, (meth-a)acrylate type monomers, vinyl ester type monomers, vinyl ether type monomers, mono-olefin type monomers, di-olefin type monomers and halogenated olefin type monomers are employable.

Examples of the aromatic vinyl type monomer are styrene type monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

As the (meth)acrylate type monomers, acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl b-hydroxyacrylate, propyl g-aminoacrylate, stearyl methacrylate, dimethylaminoethyl methacrylate and diethylaminoethyl methacrylate are cited.

Listed as vinyl ester based monomers are vinyl acetate, vinyl propionate, and vinyl benzoate.

Listed as vinyl ether based monomers are vinyl methyl ether, vinyl ethyl ether, vinyl isobutyl ether, and vinyl phenyl ether.

Listed as monoolefin based monomers are ethylene, propylene, isobutylene, 1-butene, 1-pentene, and 4-methyl-1-pentene.

Listed as diolefin based monomers are butadiene, isoprene, and chloroprene.

Listed as halogenated olefin based monomers are vinyl chloride, vinylidene chloride, and vinyl bromide.

(2) Crosslinking Agent

In order to improve the characteristics of toner, as added crosslinking agents are radical polymerizable crosslinking agents. As examples of the crosslinkable monomers, ones having two or more unsaturated bonds such as divinylbenzene, divinylnaphthalene, divinyl ether, diethylene glycol methacrylate, ethylene glycol dimethacrylate and diallyl phthalate are cited.

(3) Radical Polymerizable Monomer Component Having an Acidic Group or Radical Polymerizable Monomer Component Having a Basic Group Listed as radical polymerizable monomers having an acidic group or a basic group are, for example, polymerizable monomers having a carboxyl group, polymerizable monomers having a sulfonic acid group, and amine based polymerizable monomers such as primary amine, secondary amine, tertiary amine and quaternary ammonium salt.

Listed as polymerizable monomers having a carboxyl group are acrylic acid, methacrylic acid, fumaric acid, maleic acid, itaconic acid, cinnamic acid, monobutyl maleate, and monooctyl maleate.

Listed as polymerizable monomers having a sulfonic acid group are styrenesulfonic acid, allylsulfosuccinic acid, and octyl allyl sulfosuccinate.

These compounds may have a structure of salts of alkali such as sodium and potassium, or salts of alkali earth metals such as calcium.

As the radical polymerizable monomer having a basic group, amine-based compound may be listed, dimethylaminoethyl acrylate, dimethylaminoethyl methacrylate, diethylaminoethyl acrylate, diethylaminoethyl methacrylate, and quaternary ammonium salts of the 4 compounds described above; and 3-diethylaminophenyl acrylate, 2-hydroxy-3-methacryloxypropyltrimethyl ammonium salt, acrylamide, N-butylacrylamide, N,N-dibutylacrylamide, piperidylacrylamide, methacrylamide, N-butylmethacrylamide, N-octadecylacrylamide; vinylpyridine, vinylpyrrolidone; vinyl N-methylpyridinium chloride, vinyl N-ethylpyridium chloride, N,Ndiallylmethylammonium chloride, and N,N-diallylethylammonium chloride may be usable.

Regarding the radical polymerizable monomers employed in the invention, the radical polymerizable monomers having an acidic group or a basic group are preferably employed in an amount of 0.1 to 15 percent by weight based on the total of said monomers. Radical polymerizable crosslinking agents are preferably employed in an amount of 0.1 to 10 percent by weight based on the total radical polymerizable monomers, even though said amount may vary depending on their characteristics.

(Chain Transfer Agents)

With the purpose of adjusting the molecular weight, commonly employed chain transfer agents may be used Chain transfer agents are not particularly limited, and for example, octylmercaptan, dodecylmercaptan, tert-dodecylmercaptan, n-octyl-3-mercaptopropionic acid ester, carbon tetrabromide, and styrene dimer, may be employed.

(Polymerization Initiator)

Radical polymerization initiators can be optionally employed as long as it is water soluble. For example, persulfates such as potassium persulfate and ammonium persulfate, azo compounds such as 4,4'-azo-bis-4-valeriate and its salt and 2,2'-azo-bis(2-aminopropane) salt, and peroxide compounds can be cited.

The above-mentioned radical polymerization initiator can be employed as redox initiators in combination with a reducing agent according to necessity. By employing said redox based initiators, polymerization activity increases whereby it is possible to lower polymerization temperature and a decrease in polymerization time can be expected.

Selected as said polymerization temperature may be any reasonable temperature, as long as it is higher than or equal to the lowest radical forming temperature. For example, the temperature range of 50 to 90° C. is employed.

However, when polymerization initiators, which work at normal temperature are employed in combination, such as a combination of hydrogen peroxide and a reducing agent (ascorbic acid), it is possible to carry our polymerization at temperature equal to or higher than room temperature.

(Surface Active Agents)

In order to carry out polymerization while using said radical polymerizable monomers, it is necessary to carry out oil droplet dispersion into a water-based medium, employing surface active agents. Though the surfactant to be used on such the occasion is not specifically limiter, the following surfactants can be exemplified as the suitable compounds.

As the ionic surfactant, for example, sulfonates such as sodium dodecylbenzenesulfonate, sodium aryl alkyl polyethersulfonate, sodium 3,3-disulfondiphenylurea-4,4-diazo-bis-amino-8-naphthol-6-sulfonat orthocarboxybenzene-azo-dimethylaniline and sodium 2,2,5,5-tetramethyl-triphenylmethane-4,4-diazo-bis-β-naphthol-6-sulfonate sulfate salts such as sodium dodecylsulfate, sodium tetradecylsulfate, sodium pentadecylsuofate and sodium octylsulfate; aliphatic acid salts such as sodium oleate, sodium laurate, sodium caprylate, sodium caprate, sodium caproate, potassium stearate and calcium oleate are cited.

Further, nonionic surface active agents can also be employed. Specifically listed as such are polyethylene oxide, and polypropylene oxide, a combination of polypropylene oxide with polyethylene oxide, esters of polyethylene glycol with higher fatty acids, alkylphenol polyethylene oxide, esters of polyethylene glycol with higher fatty acid, and esters of polypropylene oxide with higher fatty acids.

In the invention, these are mainly employed as an emulsifier during emulsion polymerization, but may be employed in other processes or to achieve other purposes.

(Coloring Agents)

Listed as coloring agents may be inorganic pigments, organic pigments and dyes.

Usually known inorganic pigments are employable. Concrete examples of the inorganic pigment are described below.

For example, carbon black such as furnace black, channel black, acetylene black, thermal black and lamp black, and magnetic powder such as magnetite and ferrite are employable as the black pigment.

These inorganic pigments can be employed solely or in a combination of plural kinds thereof. The adding amount of the pigment is from 2 to 20%, and preferably from 3 to 15%, by weight of the polymer.

When said inorganic pigments are employed as magnetic toner, it is possible to add said magnetite. In this case, from the viewpoint of providing the specified magnetic characteristics, said magnetite is preferably added to toner in an amount of 20 to 60 percent by weight.

Usually known inorganic pigments are employable. Concrete examples of the inorganic pigment are described below.

The pigments for magenta or red color are, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. pigment red 166, C.I. pigment red 177, C. I. pigment red 178—C.I. pigment red 222 grade may be listed.

The pigments for orange or yellow color are, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Pigments for green or blue color are, for example, C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Further, Employed as dyes, Solvent Red 1, C.I. Solvent Red 49, C.I. Solvent Red 52, C.I. Solvent Red 58, C.I. Solvent Red 63, C.I. Solvent Red 111, and C.I. Solvent Red 122; C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. and Solvent Yellow 162; C.I. Solvent Blue 25, C.I. Solvent Blue 36, C.I. Solvent Blue 60, C.I. Solvent Blue 70, C.I. Solvent Blue 93, and C.I. Solvent Blue 95, and these may be employed in combination.

These inorganic pigments can be employed solely or in a combination of plural kinds thereof. The adding amount of the pigment is from 2 to 20%, and preferably from 3 to 15%, by weight of the polymer.

Said coloring agents may be subjected to surface modification and subsequently employed. Employed as surface modifying agents may be conventional ones known in the art. Specifically, silane coupling agents, titanium coupling agents, and aluminum coupling agents may be preferably employed.

Toner according to the invention may be employed in combination with releasing agents. For example, employed as releasing agents may be low molecular weight polyolefin waxes such as polypropylene and polyethylene, paraffin waxes, Fischer-Tropsh waxes, and ester waxes.

Further, in the invention, ester waxes, represented by General Formula (1) given below, may be preferably employed.

$$R_1—(OCO—R_2)_n \qquad \text{General Formula (1)}$$

In the formula, n is an integer of from 1 to 4, preferably from 2 to 4, more preferably from 3 to 4, and most preferably 4.

R1 and R2 are each a hydrocarbon group which may have a substituent.

R1 has from 1 to 40 carbon atoms, preferably has from 1 to 20 carbons atoms, and more preferably has from 2 to 5 carbons atoms; R2 has from 1 to 40 carbon atoms, preferably has from 13 to 29 carbons atoms, and more preferably from 12 to 25 carbon atoms. Specific examples of crystalline compounds, having an ester group according to the invention, are shown below. However, the invention is not limited to these examples.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $——(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

-continued

16)

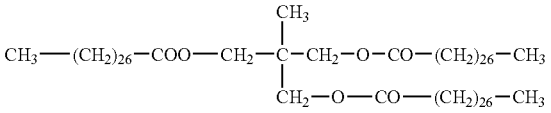

17)

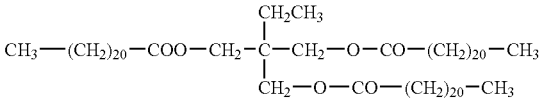

18)

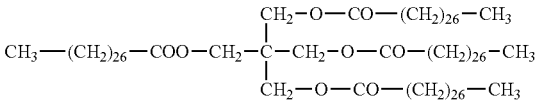

19)

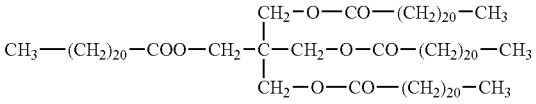

20)

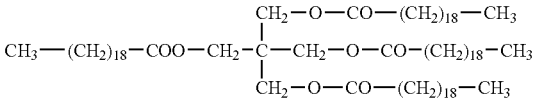

21)

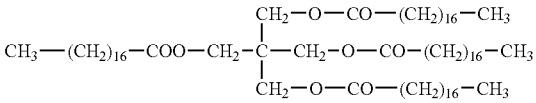

22)

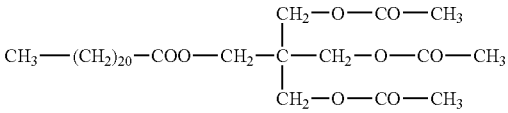

These ester waxes are incorporated into resinous particles and function to provide excellent fixability (adhesion properties to the image receiving member) to the toner which has been prepared by fusing resinous particles.

The content ratio of releasing agents employed in the invention is preferably from 1 to 30 percent by weight, based on the weight of all the toners, is more preferably from 2 to 20 percent by weight, and is further more preferably from 3 to 15 percent by weight.

Further, said releasing agents are dissolved in the aforesaid polymerizable monomers, and the resultant solution is dispersed into water. Subsequently, the resultant dispersion undergoes polymerization, and particles are formed in which the ester based compounds, described above as a releasing agent, are incorporated in the resinous particles. Subsequently, said toner is prepared through a process in which the resultant particles are salted out/fused together with said coloring agent particles.

In addition to said coloring agents and releasing agents, materials, which can provide various functions, may be added as toner materials to the toner according to the invention. Specifically, listed are charge control agents. These components may be added employing various methods such a method in which during the stage of said salting-out/fusion, said components are simultaneously added with said resinous particles as well as said coloring agents so that said components are included in toner particles, and a method in which said components are directly added to said resinous particles.

It is possible to employ various charge control agents, known in the art, and can be dispersed into water. Listed as specific examples are nigrosine based dyes, metal salts of naphthenic acid or higher fatty acids, alkoxylated amines, quaternary ammonium salts, azo based metal complexes, metal salicylates or metal complexes thereof.

External additive agent used for toner is explained.

For the purpose of improving fluidity and chargeability, as well as of enhancing cleaning properties, so-called external additives may be employed via addition to the toner according to the invention. These external additives are not particularly limited, but various fine inorganic and organic particles, as well as slipping agents can be employed.

Usually known inorganic pigments are employable. Specifically, fine particles of silica, titanium, and alumina may be preferably employed. As said fine inorganic particles, hydrophobic ones are preferred. In concrete, the silica fine particle such as R-805, R-976, R-974, R-972, R-812 and R-809 each manufactured and marketed by Nihon Aerogel Co., Ltd., HVK-2150 and H-200 manufactured by Hoechst Co., Ltd., TS-720, TS-530, TS-610, H-5 and MS-5 each manufactured and marketed by Cabot Co., Ltd., are cited.

As the titan fine particle, for example, T-805 and T-604 each manufactured and marketed by Nihon Aerogel Co., Ltd., MT-100S, AT-100B, MT-500BS, MT-600, MT-600SS and JA-1 each manufactured and marketed by Teica Co., Ltd., TA-300SI, TA-500, TAF-130, TAF-510 and TAF-510T each manufactured and marketed by Fuji Titan Co., Ltd., and IT-S, IT-OA, IT-OB and IT-OC manufactured and marketed by Idemitsu Kosan Co., Ltd., are cited.

As the alumina fine particle, for example, RFY-C and C-604 each manufactured and marketed by Nihon Aerogel Co., Ltd., and TTO manufactured and marketed by Ishihara Sangyo Co., Ltd., are cited.

Spherical organic fine particles having a number average primary particle diameter of from 10 to 2,000 nm can be employed as the organic fine particles.

Employed as materials for such fine organic particles may be homopolymers of styrene and methylmethacrylate and copolymers thereof.

Listed as slipping agents are, for example, salts of higher fatty acids such as salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; as well as salts of ricinolic acid with zinc and calcium.

The content ratio of these external additives is preferably from 1 to 5 percent by weight with respect to the toner.

Usually known various kinds of mixer such as a tabular mixer, a HENSCHEL MIXER, a nauter mixer and a V type mixer are applicable as the adding method of the external additive.

The production method of the toner is described below.

<<Manufacturing Process>>

It may be preferable to produce toner of a present invention by a polymerizing method, comprises; a process to disperse a polymerizable monomer like the above description or the polymerizable monomer solution dissolving a releasing agent in a water base media; subsequently, a process to adjust the resin particles which includes the releasing agent by a polymerizing method; a process to fuse the resin particles in the aqueous medium using the above-prepared resin particle dispersion; a washing process for filtering the resultant particles and removing the surfactant; a process for drying the washed particles; and an external additive adding process for adding an external additive to the dried particles. Thus obtained resin particle may be a colored particle. A non-colored particle may be employed as the resin particle. In such the case, the colored particle can be formed by adding a dispersion of colorant particle to the dispersion of the resin particle and fusing the both kinds of particles.

As the method for fusing, a method is particularly preferred in which the resin particles prepared by the polymerization method are salted out/fused.

When the non-colored resin particles are employed, the resin particles and the colorant particles can be salted out/fused in the aqueous medium.

Moreover, the constituting component of the toner, other than the colorant and the parting agent, such as the charge controlling agent can be added in a particle state in the above process.

The aqueous medium is principally composed of water and the content of water is not less than 50% by weight. The water-miscible organic solvent such as methanol, ethanol, iso-propanol, butanol, acetone, methyl ethyl ketone and tetrahydrofuran, can be employed other than water. Alcohol type solvent such as methanol, ethanol, iso-propanol and butanol, are particularly preferred, which are organic solvents capable of not dissolving the resin.

The polymerization method is preferable in which a monomer solution containing the parting agent is dispersed into a state of oil droplets with mechanical energy in an aqueous medium containing a surfactant in a concentration less than the critical micelle formation concentration and a water-soluble polymerization initiator is added to the resultant dispersion for progressing a radical polymerization. In such the case, it is allowed to add an oil-soluble polymerization initiator to the monomer.

Though the dispersing machine for oil droplet dispersing is not specifically limited, for example, CLEAMIX, an ultrasonic disperser, a mechanical homogenizer, Manton-Goulin homogenizer and pressing homogenizer are applicable.

The colorant may be subjected to a surface improving treatment. The surface improving treatment of the colorant is carried out by that the colorant is dispersed in a solvent and a surface improving agent is added to the dispersion and reacted by heating. After completion of the reaction, the colorant is filtered and repeatedly subjected to washing and filtering with the same solvent and then dried to obtain the pigment treated by the surface improving agent.

The colorant particle is prepared by dispersing the colorant in an aqueous medium. The dispersing treatment is preferably carried out in water containing a surfactant in a concentration larger than the critical micelle concentration (CMC).

Though the dispersing machine for oil droplet dispersing is not specifically limited, for example, a pressing type dispersing machine such as CLEAMIX, an ultrasonic disperser, a mechanical homogenizer, Manton-Goulin homogenizer and pressing homogenizer and a medium type dispersing machine such as a sand grinder, Getzman Mill and a diamond fine mill are applicable.

The foregoing surfactants can be used here.

In the process for salting out/fusing, the salting out agent composed of an alkali metal salt or an alkali-earth metal salt is added in a concentration larger than the critical coagulation concentration to water containing the resin particles and the colorant particles and then the system is heated by a temperature higher than the glass transition point of the resin particles so as to simultaneously progress the salt out and the fusion of the particles.

In the alkali metal salts and the alkali-earth metal salts employed as the coagulation agent, lithium, potassium and sodium as the alkali metal, and magnesium, calcium, strontium and barium as the alkali-earth metal are usable. Chloride, bromide, iodide, carbonate and sulfate of the above metals are employable.

Though the method for obtaining the particle size distribution of the toner is not specifically limited, for example, a method by classification, a method by controlling the temperature or the time on the occasion of the association and a method by controlling the stopping condition for completing the association are applicable.

The method is particularly preferable in which the association time, association temperature or the stopping rate in water is controlled. Therefore, in the case of slating out/fusion method is applied, it is preferable that the standing time after the addition of the coagulation agent is made as short as possible. Though the reason of such the fact is not cleared, the coagulation state of the particles is varied depending on the standing time after the salting out so as to pose problems such as that the size distribution is made instable and the surface property of the fused toner particle is varied. The temperature at the addition of the coagulation agent is not specifically limited.

It is preferable that the temperature of the dispersion of the resin particle is raised as rapid as possible by a temperature higher than the glass transition point of the resin. The time for raising the temperature is less than 30 minutes and preferably less than 10 minutes.

It is necessary to raise the temperature as rapid as possible, and the raising rate is preferably not less than 1° C./minute. Though the lower limit of the rate is not cleared, a rate of not more than 15° C./minute is preferred from the viewpoint of preventing the formation of coarse particles caused by excessively rapid progressing of the salt out/fusion. In the particularly preferred embodiment, the salt out/fusion is continuously progressed after the temperature is reached at a temperature higher than the glass transition point. By such the method, the fusion is effectively progressed together with the growing of the particles and the durability of the final toner can be improved.

The particle diameter can be effectively controlled by employing the di-valent metal salt for salting out/fusing on the occasion of the association. Though the reason of such the fact is not cleared, it is supposed that the repulsive force at the time of salting out is increased by the use of the divalent metal salt so that the dispersing effect of the surfactant can be effectively inhibited and the particle size distribution can be controlled.

The addition of the mono-valent metal salt and water is preferable for stopping the salt out/fusion.

The salting out can be stopped by the addition of such the materials so that the formation of the particles having large diameter or small diameter can be controlled.

In the polymerized toner formed by the association or fusion of the resin particles in the aqueous medium, the shape distribution and the shape of the entire toner can be optionally varied by controlling the stream of the medium and the temperature distribution in the reaction vessel in the fusing process and the heating temperature, the rotating number of stirrer and the time in the shape controlling process after the fusion.

In the polymerized toner produced by the association or the fusion of the resin particles, the toner having the shape coefficient and the uniform shape distribution according to the invention can be formed by controlling the temperature, rotating number of the stirrer and the time in the fusing and shape controlling processes in which a stirring wing and a stirring tank are used, by which the stream of the dispersion can be made to laminar flow and the temperature distribution in the tank can be made uniform. It is supposed that, when the fusion is carried out in the laminar flowing field, the particles in the course of the association and fusion are not subjected to strong stress and the temperature distribution in the stirring tank is uniform in the presence of the laminar flow in which the flowing rate is accelerated so that the shape distribution of the fused particles is become uniform. Furthermore, the shape of the fused particle is gradually made sphere by heating and stirring in the following shape controlling process, and the shape of the particle can be optionally controlled.

It is preferable that the salting out and the fusing are simultaneously progressed for controlling the toner to the designated shape. By the method in which the coagulated particles are heated after the coagulation, the distribution of the shape tends to be wide and the formation of fine particle cannot be inhibited. It is supposed that the coagulated particle is re-divided and the fine particles are easily formed since the coagulated particle is heated in the aqueous medium while subjected to be stirred.

(Developer)

Although one component developer or two-component developer is sufficient as toner, the two-component developer is preferable.

When using as one component developer, there may be a method of using the above-mentioned toner as it is as a nonmagnetic one component developer, but usually, toner particles is made to contain about 0.1–5 μm magnetic particle and used as a magnetic one component developer. As the containing method, it is common to make it contain in aspherical form particles as same as a colorant.

Moreover, it can be used as a two-component developer by being mixed with carrier. In this case, a well-known material is used as a magnetic particle of a carrier, such as an alloy of metals, such as iron, ferrite, and magnetite, and metals, such as an alminum and lead. Especially ferritic particles are desirable. The magnetic particle is preferably one having a volume-based median diameter (D50) of from 15 to 100 μm, and more preferably from 25 to 60 μm.

The measurement of the volume-based median diameter (D50) can be performed by a laser diffraction particle size distribution measuring apparatus HELOS, manufactured by Sympatec Co., Ltd., having a wet type dispersion means.

As the carrier, a magnetic particle coated with resin and a resin dispersed type carrier composed of magnetic particles dispersed in the resin are preferred.

Though the resin composition for coating is not specifically limited, for example, olefin type resins, styrene type resins, Styrene-acryl type resins, silicone type resins, ester type resins or fluorine-containing polymer type resins are employable. As the resin for constituting the resin dispersed type carrier, known ones can be employed without any limitation, for example, styrene-acryl type resins, polyester resins, fluorinated type resins and phenol resins are usable.

Next, a photoreceptor is explained in details.

As an electrophotography photoreceptor, although any of an inorganic photoreceptor and an organic photoreceptor may be used, an organic photoreceptor is desirable from viewpoints such as excellent color sensitivity to laser light used for image-wise exposure at the time of latent-image formation and manufacturing efficiency.

The organic photoreceptor is an electrophotographic photoreceptor in which at least one of the charge generation function and the charge transfer function essential for constituting the electrophotographic photoreceptor is charged with an organic compound, which entirely includes photoreceptors such as those constituted by a known charge generation material or a known charge transfer material and those in which the charge generation function and the charge transfer function are also charged on a high molecular weight complex.

It is desirable that the photoreceptor surface of an electrophotography photoreceptor has the physical property of low surface energy and thereby raising the transferring ability of toner from a photoreceptor to an intermediate transfer member. As the countermeasure for this, the first one is that the surface layer of the photoreceptor of the present invention is made into the surface layer containing fluorine based resin particles, and the other one is that a surface energy lowering agent is provided on the surface of the photoreceptor. Whereby the surface energy of a photoreceptor is made small, and the transferring ability of toner from a photoreceptor to an intermediate transfer member can be made excellent. By employing both of reducing the surface energy of this photoreceptor and using the toner group whose toner turbidity was prepared as mentioned above. The transfer efficiency of both the primary transferring ability and the secondary transferring ability of toner in the image formation apparatus using an intermediate transfer member can be enhanced. According to the synergistic effect, it is possible to offer a color electro-photographic picture image in which the sharpness of a character picture image and a color picture image becomes excellent and a hue reproduction become excellent.

Moreover, it is desirable that the contact angle over the water of the surface layer of an electro-photographic photoreceptor is 90° or more. By making the contact angle over water into 90° or more, while improving the cleaning ability of toner, a transferring ability of toner from a photoreceptor to an intermediate transfer member can be made excellent.

As the above-mentioned fluorine based resin particles, for example, resin particles of polytetrafluoroethylene, polyvinylidene fluoride, poly-3-fluoridationethylenechloride, polyvinyl fluoride, poly 4 fluoridation ethylene-perfluoroalkyl vinyl ether copolymer, poly 4 fluoridation ethylene-6 fluoridation propylene copolymer, polyethylene-3 fluoridation ethylene copolymer, poly 4 fluoridation ethylene-6 fluoridation propylene-perfluoro alkyl vinyl ether copolymer may be usable. The median diameter (D50) of a volume basis is 0.05–10 μm preferably, more preferably it is 0.1–5 μm. Moreover, the quantity of fluorine based resin particles contained in a photoreceptor is 0.1–90 weight % preferably to binder resin of the surface layer of the photoreceptor, it is 1–50 weight % more preferably. When the quantity is less than 0.1%, a sufficient abrasion resistance or a lubricity cannot be given for a light sensitive layer, the improvement of the primary transfer ability of the above-mentioned toner is small, and it is easy to cause fall-off of an image density, an imperfect transfer, and deterioration of sharpness etc.

When the quantity exceeds 90 weight %, formation of a surface layer tends to become difficult.

Incidentally, the volume-based median diameter (D50) of the above-mentioned fluorine based resin particles can be measured by a laser diffraction/scattering type particle size distribution measuring device "LA-700" (made by Horiba Ltd.). Moreover, as the surface contact angle of a photoreceptor, a contact angle over pure water can be measured under 20° C. 50% RH of circumstances by the use of a contact angle meter (CA-DT-A type: made by a Kyowa Interface Science Co., Ltd. company).

Practical example of the photosensitive layer composition is described.

Electroconductive Support

An electroconductive support having a sheet shape or cylinder shape is used.

The cylindrical electroconductive support is a cylindrical support on which an images can be endlessly formed by its rotation. The electroconductive support having a straightness of not more than 0.1 mm and a swing width of not more than 0.1 mm is preferred. When the straightness degree and the swinging exceed the above range, the suitable image formation is become difficult.

A drum metal such as aluminum or nickel, a plastic drum on the surface of which aluminum, tin oxide or indium oxide is provided by evaporation, and a plastic and paper drum each coated with an electroconductive substance may be used as the material of an electroconductive support. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Interlayer

In the present invention, an interlayer, functioning as a barrier, may be provided between the electrically conductive support and the photosensitive layer. Especially, the intermediate layer which contains titanium oxide fine particles dispersed into binder resin, such as a polyamide, is desirable. The average particle diameter of the titanium oxide particles is preferably in the range between 10 nm and 400 nm and more preferably in the range between 15 nm and 200 nm in terms of the number-based average primary particle diameter. If the size is smaller than 10 nm the effect of preventing Moire generation in the intermediate layer is small. On the other hand, if the size exceeds 400 nm, occurrence of precipitation of the titanium oxide particles in the intermediate layer coating solution becomes likely, and as a result, the uniform distribution of the titanium oxide particles in the intermediate layer becomes poor, and also an increase in black spotting is likely to occur. The intermediate layer coating solution using titanium oxide particles for which number-based average primary particle diameter is in the range defined above is favorable, and the intermediate layer that is formed from this type of coating solution functions to prevent the generation of black spotting, and in addition, is favorable in terms of environmental properties and its resistance to cracking.

The titanium oxide particles may have a dendrite, needle shaped, or granular configuration, and the titanium oxide particles having these configurations may for example be a crystalline type such as an anatase type, a rutile type or an amorphous type for the titanium oxide crystal. Any of the crystal types may be used, and 2 or more of the crystal types may be mixed and used. Among these, the rutile type and the granular type are most favorable.

It is desirable that surface treatment is carried out to titanium oxide particles. Especially, it is desirable that the surface treatment is performed plural times, and in the surface treatment of the plural times, the last surface treatment performs surface treatment using a reactant organic silicon compound. In addition at least one of the plurality of surface treatments is one in which surface treatment with at least one substance selected from alumina, silica, and zirconia is done, and it is preferable that the surface treatment using the organic silicon compound is carried out at the last step.

Incidentally, an alumina treatment, a silica treatment and a zirconia treatment are each a treatment for precipitating alumina, silica and zirconia on the surface of the titanium oxide, respectively. The alumina, silica and zirconia precipitated onto the surface each include the hydrated compound thereof, respectively.

The surface treatment by the reactive organic silicon compound is a treatment employing the reactive organic silicon compound.

The surface of the titanium oxide particle can be uniformly covered by two or more times of the treatments. The titanium oxide particles can be suitably dispersed in the intermediate layer and the good photoreceptor not causing image defect such as the black spots can be obtained by the use of such the treated titanium oxide particles in the intermediate layer.

As a desirable reactant organic silicon compound used for surface treatment, various kinds of alkoxysilane and methyl hydrogen polysiloxane, such as a methyltrimethoxysilane, n-butyltrimethoxysilane, n-hexyltrimethoxysilane, and dimethyldimethoxy silane, may be listed up.

Light Sensitive Layer

It is preferable that the photosensitive layer having a charge generation layer CGL and a charge transfer layer CTL separated from each other even though a single structure photosensitive layer having both of the charge generation function and the charge transfer function may be used.

The increasing of the remaining potential accompanied with repetition of the use can be inhibited and another electrophotographic property can be suitably controlled by the separation the functions of the photosensitive layer into the charge generation and the charge transfer.

In the photoreceptor to be negatively charged, it is preferable that the CGL is provided on a subbing layer and the CTL is further provided on the CGL. In the photoreceptor to be positively charged, the order of the CGL and CTL in the negatively charged photoreceptor is revered. The foregoing photoreceptor to be negatively charged having the function separated structure is most preferable.

The photosensitive layer of the function separated negatively charged photoreceptor is described below.

Charge Generating Layer

A charge generating layer contains a charge generating material (CGM). In addition, the charge generating layer may contain a binder resin and other additives as necessary.

As the charge generating material (CGM), for example, phthalocyanine pigment, azo pigment, a perylene pigment, an azulenium pigment can be applied.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.01 to 2 μm.

Charge Transporting Layer

A charge transporting layer contains a charge transporting material (CTM) and a binder resin for dispersing the CTM and forming a layer. In addition, the charge transporting layer may contain additives such as an antioxidant agent as necessary.

As a charge transporting material (CTM), a known charge transporting material (CTM) can be used. For example, triphenylamines, hydrazones, styryl compound, benzidine compound, butadiene compound can be applied. These charge transporting materials are usually dissolved in a proper binder resin to form a layer.

Both thermoplastic resin and thermosetting resin are used as binder resin used for Charge transporting layer (CTL). For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly-N-vinyl carbazole may be usable. The most preferred material is polycarbonate resin in view of, smaller water absorbing rate, dispersing ability of the CTM and electrophotosensitive characteristics.

Ratio of the binder resin is preferably 10 to 200 parts by weight to 100 parts of charge transporting material by weight. Further it is preferable that film thickness of the charge transporting layer is 10–40 μm.

A charge transporting layer may consist of two or more layers. When a charge transporting layer is constructed by two or more layers, it is desirable to make the top layer of a charge transporting layer to contain the fluorine based resin particles described above, and to make it as the surface layer of the photoreceptor.

As mentioned above, although the most desirable layer structure of the photoreceptor was exemplified, in a present invention, any photoreceptor layer structure other than the above may be used.

FIG. 1 is a cross sectional schematic view of the color image forming apparatus indicating an embodiment of the present invention.

The color image forming apparatus is referred to as a tandem type color image forming apparatus, which is composed of a plurality of image forming units 10Y, 10M, 10C, and 10Bk, a belt-shaped intermediate transfer medium unit 7, a paper feed and conveying means 21, and a fixing means 24. On the upper part of a main unit A of the image forming apparatus, a document image reader SC is arranged.

The image forming unit 10Y for forming yellow images has a charging means 2Y arranged around a drum-shaped photoconductor 1Y as a first image carrying member, an exposure means 3Y, a developing means 4Y, a primary transfer roller 5Y as a primary transfer means, and a cleaning means 6Y. The image forming unit 10M for forming magenta images has a drum-shaped photoconductor 1M as a first image carrying member, a charging means 2M, an exposure means 3M, a developing means 4M, a primary transfer roller 5M as a primary transfer means, and a cleaning means 6M. The image forming unit 10C for forming cyan images has a drum-shaped photoconductor 1C as a first image carrying member, a charging means 2C, an exposure means 3C, a developing means 4C, a primary transfer roller 5C as a primary transfer means, and a cleaning means 6C. The image forming unit 10Bk for forming black images has a drum-shaped photoconductor 1Bk as a first image carrying member, a charging means 2Bk, an exposure means 3Bk, a developing means 4Bk, a primary transfer roller 5Bk as a primary transfer means, and a cleaning means 6Bk.

The belt-shaped intermediate transfer medium unit 7 has a belt-shaped intermediate transfer medium 70 as a second image carrying member in a semiconductive endless belt shape which is wound by a plurality of rollers and is supported rotatably.

Images of various colors formed by the image forming units 10Y, 10M, 10C, and 10Bk are sequentially transferred onto the belt-shaped intermediate transfer medium 70 rotated by the primary transfer rollers 5Y, 5M, 5C, and 5Bk as primary transfer means and a composite color image is formed. A paper P as a recording material (a supporter for carrying a fixed final image, for example, a plain paper, a transparent sheet, etc.) stored in a paper feed cassette 20 is fed by the paper feed means 21 and is conveyed to a secondary transfer roller 5A as a secondary transfer means via a plurality of intermediate rollers 22A, 22B, 22C, and 22D and a resist roller 23, and color images are secondarily transferred on the paper P in a batch. The paper P transferred with color images is fixed by the fixing means 24, is held by paper ejection rollers 25, and is loaded on a paper ejection tray 26 outside the equipment.

On the other hand, from the belt-shaped intermediate transfer medium 70 which transfers color images on the paper P by the secondary transfer roller 5A as a secondary transfer means and then curvature-separates the paper P, residual toner is removed by a cleaning means 6A.

During the image forming process, the primary transfer roller 5Bk is always pressed to the photoconductor 1Bk. The other primary transfer rollers 5Y, 5M, and 5C, only during forming color images, are respectively pressed to the corresponding photoconductors 1Y, 1M, and 1C.

The secondary transfer roller 5A, only when the paper P passes here and is secondarily transferred, is pressed to the belt-shaped intermediate transfer medium 70.

Further, from the main unit A of the apparatus, a cabinet 8 can be pulled out via support rails 82L and 82R.

The cabinet 8 is composed of the image forming units 10Y, 10M, 10C, and 10Bk and the belt-shaped intermediate transfer medium unit 7.

The image forming units 10Y, 10M, 10C, and 10Bk are lengthwise arranged in the vertical direction. On the left of the photoconductors 1Y, 1M, 1C, and 1Bk shown in the drawing, the belt-shaped intermediate transfer medium unit 7 is arranged. The belt-shaped intermediate transfer medium unit 7 is composed of the belt-shaped intermediate transfer medium 70 which can rotate round rollers 71, 72, 73, 74, and 75, the primary transfer rollers 5Y, 5M, 5C, and 5Bk, and the cleaning means 6A.

By the pull-out operation of the cabinet 8, the image forming units 10Y, 10M, 10C, and 10Bk and the belt-shaped intermediate transfer medium unit 7 are integrally pulled out from the main unit A.

The support rail 82L on the left of the cabinet 8 shown in the drawing is arranged in the space above the fixing means 24 on the left of the belt-shaped intermediate transfer medium 70. The support rail 82R on the right of the cabinet 8 shown in the drawing is arranged in the neighborhood under the developing means 4Bk on the lowest part. The support rail 82R is arranged in the location free of impediment to the removal operation of the developing means 4Y, 4M, 4C, and 4Bk from the cabinet 8.

The right part of the photoconductors 1Y, 1M, 1C, and 1Bk of the cabinet 8 shown in the drawing is surrounded by the developing means 4Y, 4M, 4C, and 4Bk, and the underneath part thereof shown in the drawing is surrounded by the charging means 2Y, 2M, 2C, and 2Bk and the cleaning means 6Y, 6M, 6C, and 6Bk, and the left part shown in the drawing is surrounded by the belt-shaped intermediate transfer medium 70.

Among them, the cleaning means and charging means form one photoconductor unit and the developing means and toner supply device form one developing unit.

The image forming apparatus of the present invention is characterized in that as a cleaning means for residual toner on the intermediate transfer medium, a plurality of cleaning blades are used. Toner including a residual monomer, particularly toner of fine particles is easily adhered onto the intermediate transfer medium and defective cleaning is easily caused. However, by use of such a plurality of cleaning blades, even if toner of fine particles having a diameter smaller than the mean value is adhered to the intermediate transfer medium, the adhered toner can be removed more effectively.

FIG. 2 shows an example of the cleaning means for the intermediate transfer medium.

The cleaning means of the intermediate transfer medium has a plurality of cleaning members (explained in the cleaning blades in this embodiment). In an embodiment of the present invention, the cleaning means 6A of the belt-shaped intermediate transfer medium, particularly as shown in FIGS. 1 and 2(*a*), has a cleaner case 61C opened opposite to the toner image carrying face of the belt-shaped intermediate transfer medium 70 and sequentially from the upstream side of the belt-shaped intermediate transfer medium 70 in the moving direction opposite to the opening of the cleaner case 61C, includes two cleaning blades, that is, an elastic blade 61A such as a urethane rubber blade and a metallic scraper 61B such as SUS. In this embodiment, the mounting structure of the elastic blade 61A and the metallic scraper 61B is that a swing arm 61D is installed swingingly in the cleaner case 61C with one end thereof used as a swing fulcrum 61E, and a part of the swing arm 61D is used as a holder 61F, and one end of each of the elastic blade 61A and the metallic scraper 61B is fixed to the holder 61F, and moreover between the free end of the swing arm 61D and the cleaner case 61C, a return spring 61G is arranged, and by a driving mechanism not shown in the drawing, the swing arm 61D swings between the cleaning position and the retracting position. Further, in FIG. 2(*a*), the brush roll of a numeral 61H is installed at the lower edge of the opening of the cleaner case 61C and collects toner removed by the elastic blade and metallic scraper. A numeral 61I indicates a flicker adsorbing toner adhered to the brush roll 61H and toner adhered to the flicker is removed by a scraper 61J and is collected by a conveying screw 61K.

Particularly, in this embodiment, the various conditions (free length, contact pressure, thickness, set angle) of the elastic blade 61A are properly selected from the viewpoint that an unnecessary load is not applied to the drive source of the belt-shaped intermediate transfer medium 70 and the cleaning performance is ensured. On the other hand, the various conditions of the metallic scraper 61B are also selected properly mainly from the viewpoint of endurance of the cleaning performance. However, from the viewpoint of more improvement of the cleaning performance by the front end of the metallic scraper 61B, for example, the edge of the front end in contact with the surface of the belt-shaped intermediate transfer medium 70 is preferably etched. Furthermore, the interval d between the elastic blade 61A and the metallic scraper 61B may be properly selected in consideration of the shape and installation position of the cleaner case 61C. However, when the interval d between the two is too close, toner stays in the gap between the two with the passage of time, and the cleaning performance may be reduced, so that the two are preferably arranged at a distance of 2 mm or more.

Furthermore, in this embodiment, the elastic blade 61A and the metallic scraper 61B are arranged in the neighboring position off the upstream side of the belt-shaped intermediate transfer medium 70 in the moving direction from the part of the belt-shaped intermediate medium 70 corresponding to the roller 5 (backup roller) and even if floating toner and dust are adhered between the roller 75 and the belt-shaped intermediate transfer medium 70 and fine convexities are formed on the surface part of the belt-shaped intermediate transfer medium 70 corresponding to the roller 75, the cleaning performance of the elastic blade 61A and the metallic scraper 61B is not affected. However, the elastic blade 61A may make contact with the part of the belt-shaped intermediate medium 70 corresponding to the roller 75. Further, in this embodiment, the cleaning means 6A is arranged in correspondence with the part of the belt-shaped intermediate transfer medium 70 positioned between the roller 75 and the roller 77 (backup roller corresponding to the brush roller 61H) and with the part of the belt-shaped intermediate transfer medium 70, the elastic blade 61A and the metallic scraper 61B are in contact.

And, the cleaning means 6A, during the cleaning cycle, moves the swing arm 61D to the cleaning position (the position closer to the belt-shaped intermediate transfer medium 70 than the retracting position) by a driving mechanism not shown in the drawing, arranges the front ends of the elastic blade 61A and the metallic scraper 61B so as to make contact with the surface of the belt-shaped intermediate transfer medium 70 at a predetermined contact pressure, in other than the cleaning cycle, for example, during the imaging cycle, moves the swing arm 61D to the retracting position against the return spring 61G by the driving mechanism not shown in the drawing, and arranges the front ends of the elastic blade 61A and the metallic scraper 61B away from the surface of the belt-shaped intermediate transfer medium 70.

As mentioned above, by use of the aspect of combination of the elastic blade 61A and the metallic scraper 61B, the drive source of the belt-shaped intermediate transfer medium 70 requires no high rotation torque, and the cleaning performance of polymerized toner of fine particles can be improved, and for fine convexities on the belt-shaped intermediate transfer medium 70, stable cleaning performance can be maintained. The actions are confirmed by the embodiment described later.

A rubber elastic body is used as a material of the elastic blade and as a material thereof, urethane rubber, silicone rubber, fluorine rubber, chloroprene rubber, and butadiene rubber are known. Among them, a urethane rubber blade is particularly preferable because the wear characteristic thereof is excellent compared with other rubber blades.

Among a plurality of cleaning blades used for the cleaning means for the intermediate transfer medium of the present invention, at least one is preferably a non-deformable member. The non-deformable member means a member which is not elastically deformed due to contact with the intermediate transfer medium during image forming. For the non-deformable member, a metallic scraper is preferably used.

Further, the metallic scraper is a thin metallic sheet with a thickness of 0.01 to 2 mm, preferably 0.02 to 0.5 mm and as a material of the thin metallic sheet, if it is a thin metallic sheet which is flexible and rigid, any metallic material is acceptable. However, a SUS 300 or SUS 400 stainless steel sheet, an aluminum sheet, and a phosphor bronze sheet are preferably used.

The contact angle $\theta_1$ of the elastic blade with the intermediate transfer medium and the contact angle $\theta_2$ of the metallic scraper with the intermediate transfer medium are preferably 5 to 35°. Further, the free length (the length of the top not fixed to the holder 61F) of each of the elastic blade and metallic scraper is preferably 6 to 15 mm.

The striking-through amount of each of the elastic blade and metallic scraper into the intermediate transfer medium is preferably set to 0.4 to 2.0 mm and more preferably set to 0.5 to 1.5 mm. The striking-through amount means a load applied to the top of the elastic blade or the top of the metallic scraper which is generated by the relative motion between the intermediate transfer medium and the elastic blade or the metallic scraper. The load, from the viewpoint of the intermediate transfer medium, is equivalent to abrasion force received from the elastic blade or metallic scraper and to specify the range thereof means that the intermediate transfer medium must sustain abrasion by proper force. Further, the striking-through amount, assuming that when the elastic blade or metallic scraper makes contact with the intermediate transfer medium, the top of the elastic blade or the top of the metallic scraper is not bent on the surface of the intermediate transfer medium but enters linearly inside it, is referred to as the striking-through length into the intermediate transfer medium.

Figure 3:
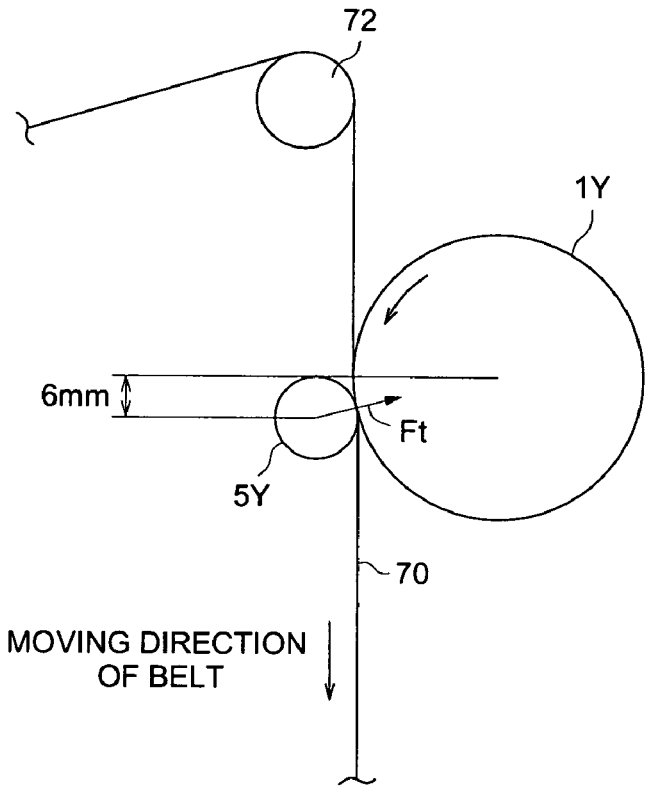
FIG. 3 is a layout diagram showing the position relationship between the photoconductor, the belt-shaped intermediate transfer member, and the primary transfer roller.

FIG. 3 is a layout diagram showing the position relationship between the photoconductor, the belt-shaped intermediate transfer medium, and the primary transfer roller. The primary transfer rollers 5Y, 5M, 5C, and 5Bk, from the rear of the belt-shaped intermediate transfer medium 70 as an intermediate transfer medium, are respectively compressed to the photoconductors 1Y, 1M, 1C, and 1Bk. However, as shown in the layout diagram in FIG. 3, on the downstream side of the contact points of the belt-shaped intermediate transfer medium 70 as an intermediate transfer medium when not compressed with the respective photoconductors 1Y, 1M, 1C, and 1Bk in the rotational direction of the photoconductors, the primary transfer rollers 5Y, 5M, 5C, and 5Bk are arranged and the respective photoconductors 1Y, 1M, 1C, and 1Bk are compressed. At this time, the belt-shaped intermediate transfer medium 70 as an intermediate transfer medium is bent along the outer periphery of each of the photoconductors 1Y, 1M, 1C, and 1Bk and on the lowermost stream side of the contact area between the photoconductors and the belt-shaped intermediate transfer medium 70, the primary transfer rollers 5Y, 5M, 5C, and 5Bk are arranged.

Figure 4:
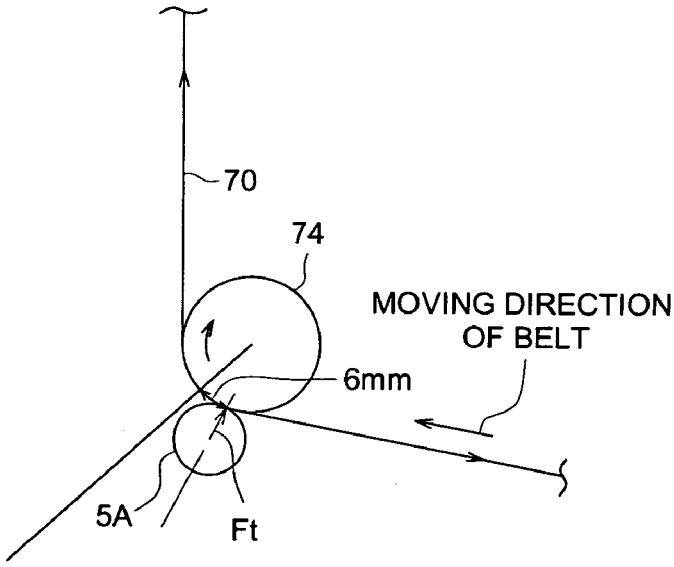
FIG. 4 is a layout diagram showing the position relationship between the backup roller, the belt-shaped intermediate transfer member, and the secondary transfer roller.

FIG. 4 is a layout diagram showing the position relationship between the backup roller, the belt-shaped intermediate transfer medium, and the secondary transfer roller. The secondary transfer roller 5A, as shown in the layout diagram in FIG. 4, is preferably arranged on the upstream side of the central contact part between the belt-shaped intermediate transfer medium 70 as an intermediate transfer medium when not compressed by the secondary transfer roller 5A and the backup roller 74 in the rotational direction of the backup roller 74.

The intermediate transfer medium uses a macromolecular film of polyimide, polycarbonate, or PVdF or synthetic rubber such as silicone rubber or fluorine rubber which is added with a conductive filler to be made conductive and although either of a drum shape and a belt shape may be used, the belt shape is preferable from the viewpoint of the degree of freedom of apparatus design.

Further, the surface of the intermediate transfer medium is preferably roughed properly. When the surface roughness Rz at the + point of the intermediate transfer medium is set to 0.5 to 2 μm, the surface energy reduction agent supplied to the photoconductors is fetched by the surface of the intermediate transfer medium, and the toner adhesive force on the intermediate transfer medium is reduced, and the secondary transfer rate of toner from the intermediate transfer medium to a recording material can be easily increased. In this case, when the surface roughness Rz at the + point of the intermediate transfer medium is larger than the surface roughness Rz at the + point of the photoconductors, the effect tends to increase.

On the other hand, the cleaning means for the photoconductors basically has a constitution that the metallic scraper is removed from the cleaning means for the intermediate transfer medium shown in FIG. 2. This cleaning means is used for the cleaning means 6Y, 6M, 6C, and 6Bk shown in FIG. 1.

EXAMPLES

Next, although embodiments of the present invention are explained concretely, the structure of the present invention is not restricted to these embodiments.

(Developer)

(Preparation of Colored Particles)

(Production of Coloring Particle 1Bk) Production of Latex

In a 5000 ml separable flask with which a stirring device, a temperature sensor, a cooling tube, and a nitrogen introducing device were attached, a solution in which 7.08 g of a anion surfactant (sodium dodecylbenzene sulfonate:SDS) was dissolved in 2760 g of ion exchanged water was prepared. Under the nitrogen air current, the temperature in a flask was raised to 80° C., while agitating the solution at the stirring velocity of 230 rpm. On the other hand, 72.0 g of an exemplification compound 19 was added in a monomer which consists of 115.1 g of styrene, 42.0 g of an n-butylacrylate and 10.9 g of methacrylic acid, was warmed and dissolved at 80° C., thereby a monomer solution was produced.

Here, mixed homogenization of the above-mentioned heated solution was mixed and dispersed by a mechanical homogenizer which has a circulation pathway, thereby emulsification particles which have a uniform diameter of a dispersion particle were produced. Subsequently, latex particles were produced by adding a solution in which 0.84 g of a polymerization initiator (potassium persulfate: KPS) into 200 g of ion exchanged water, and heating and agitating at 80° C. for 3 hours. Further, subsequently, an initiator solution composed of 7.73 g of a polymerization initiator (KPS) dissolved in 240 ml of on exchanged water was added, and then 15 minutes later, a mixture liquid composed of 383.6 g of styrene, 140 g of n-butyl acrylate, 36.4 g of methacrylic acid and 14.0 g of n-octyl 3-mercaptopropionateester was dropped spending 120 minutes at a temperature of 80° C.

After the dropping ended, it was cooled to 40° C. after carrying out heating stirring for 60 minutes, and the polymerization reaction was stopped. Then, under the reduced pressure (reduced-pressure condition: 1.33 kPa), the remaining monomers was removed and "latex particles" was obtained.

Preparation of Colored Particles 9.2 g of n-sodium dodecyl sulfate was stirred and dissolved into 160 ml of ion exchanged water.

20 g of REGAL 330R(carbon black by Cabot Corp.) was gradually added to this liquid under stirring, and, subsequently was dispersed by using CLEAMIX. As a result of measuring the particle size of the above-mentioned dispersion liquid using electrophoresis light-scattering photometer ELS-800 by an OTSUKA ELECTRONICS CO., LTD. company, it was 112 nm in diameter of a weight average. This dispersion liquid was referred as "Colorant Dispersion Liquid".

1250 g of "latex particles", 2000 ml of ion exchanged water, and the above-mentioned "Colorant Dispersion Liquid" are put into a 5 liter 4 mouth flask attached with a temperature sensor, a condenser tube, a nitrogen introduction apparatus, and a stirring apparatus, and are agitated. After adjusting to 30° C., five mols/liter of sodium hydroxide aqueous solution was added to this solution, and pH was adjusted to 10.0. After that, a solution of 12.1 g of magnesium chloride hexahydrate in 1,000 ml of deionized water was added to the above liquid spending 10 minutes at 30° C.

Then, after leaving it alone for 2 minutes, temperature rising was started and the liquid temperature was raised to 90° C. in 5 minutes (heating rate=12° C./minutes).

A particle size was measured with COULTER COUNTER TAII in the state, when volume-based median diameter (D50) became to 4.3 μm, an aqueous solution which dissolved 115 g of sodium chloride in 700 ml of ion exchanged water was added, and grain growth was stopped, continuously further, and at 85° C.±2° C. of the liquid temperature, heating stirring was carried out for 8 hours, and a salting-out/fusion was conducted for it. Then, it was cooled to 30° C. on a condition of 6° C./min, hydrochloric acid was added, pH was adjusted to 2.0, and stirring was stopped.

The produced coloring particles were filtered/washed on the following condition, after that, it was dried by 40° C. warm air, and thereby coloring particles were obtained. This thing was referred as "coloring particle 1Bk". The particle size distribution and the amount of remaining monomers of coloring particle 1Bk are shown in a table 1.

(Production of Coloring Particle 6Bk–8Bk)

In the production of coloring particle 1Bk, the reduced pressure condition in the manufacturing process of latex and the magnesium chloride added amount in the manufacturing process of coloring particles, the heating rate to 90° C. of solution temperature, the addition timing of sodium chloride, etc. were changed, and coloring particle 2Bk–12Bk of the particle size distribution and the amount of remaining monomers described in Table 1 were manufactured.

(Production of the Coloring Particles 1Y–12Y)

In each production of coloring particle 1Bk–12Bk, C.I. pigment yellow 185 was used instead of REGAL 330R (carbon black by Cabot Corp.) used for the production of "colorant dispersion liquid", and the condition was made the same except that the reduced pressure condition in the manufacturing process of latex and the magnesium chloride added amount in the manufacturing process of coloring particles, the heating rate to 90° C. of solution temperature, the addition timing of sodium chloride, etc. were changed, thereby coloring particles 1Y–12Y were obtained. The particle size distribution and the amount of remaining monomers of the coloring particles 1Y–12Y are shown in Table 1.

(Production of the Coloring Particles 1M–12M)

In each production of coloring particle 1Bk–12Bk, C.I. pigment red 122 was used instead of REGAL 330R (carbon black by Cabot Corp.) used for the production of "colorant dispersion liquid", and the condition was made the same except that the reduced pressure condition in the manufacturing process of latex and the magnesium chloride added amount in the manufacturing process of coloring particles, the heating rate to 90° C. of solution temperature, the addition timing of sodium chloride, etc. were changed, thereby coloring particles 1M–12M were obtained. The particle size distribution and the amount of remaining monomers of the coloring particles 1M–12M are shown in Table 1.

(Production of the Coloring Particles 1C–12C)

In each production of coloring particle 1Bk–12Bk, C.I. pigment blue 15:3 was used instead of REGAL 330R (carbon black by Cabot Corp.) used for the production of "colorant dispersion liquid", and the condition was made the same except that the reduced pressure condition in the manufacturing process of latex and the magnesium chloride added amount in the manufacturing process of coloring particles, the heating rate to 90° C. of solution temperature, the addition timing of sodium chloride, etc. were changed, thereby coloring particles 1C–12C were obtained. The particle size distribution and the amount of remaining monomers of the coloring particles 1C–12C are shown in Table 1.

Incidentally, the remaining monomers of the above-mentioned coloring particles was measured by the use of the above mentioned head space gas-chromatography-measurement method.

(Production of Toner Particles)

One weight % of hydrophobic silica (the number average first order particle diameter=12 nm, degree of hydrophobilization=68) and 0.5 weight % of hydrophobic titanium oxides (the number average first order particle diameter=20 nm, degree of hydrophobilization=63) were added to each of the coloring particle 1Bk–12Bk, the coloring particles 1Y–12Y, the coloring particles 1M–12M, and the coloring particles 1C–12C which were obtained, and they were mixed by the Henschel mixer, and thereby toner 1Bk–12Bk, toner 1Y–12Y, toner 1M–12M, and toner 1C–12C were obtained.

Incidentally, the amount of remaining monomers and the particle size distribution of toner 1Bk–12Bk, toner 1Y–12Y, toner 1M–12M, and toner 1C–12C were the same as the amount of remaining monomers and the particle size distribution of coloring particle 1Bk–12Bk and coloring particles 1Y–12Y, the coloring particles 1M–12M, and the coloring particles 1C–12C each corresponding to them respectively.

Each of the above-mentioned toner particles was mixed with ferrite carriers of 60 μm of volume-based median sizes (D50) which were covered the silicone resin, and Developer 1Bk–12Bk, Developers 1M–12M, and Developers 1C–12C each having a toner concentration of 6% were produced respectively, and thereby the developer groups 1–12 described in Table 1 were produced.

TABLE 1

| Developing agent group No. | Coloring particle No. (=Toner No.) | 50% volume average particle diameter (Dv50) (μm) | 50% number average particle diameter (Dp50) (μm) | Dv50/Dp50 | Cumulative 75% volume average particle diameter (Dv70) (μm) | Cumulative 75% number average particle diameter (Dp70) (μm) | Dv75/Dp75 | Number % of particles lower than 0.7 × Dp50 | Amount of remaining monomer (ppm) |
|---|---|---|---|---|---|---|---|---|---|
| 1 | 1Bk | 4.6 | 4.3 | 1.07 | 4.1 | 3.7 | 1.11 | 7.8 | 122 |
| | 1Y | 4.7 | 4.4 | 1.06 | 4.2 | 3.8 | 1.10 | 7.9 | 118 |
| | 1M | 4.6 | 4.3 | 1.07 | 4.1 | 3.7 | 1.12 | 7.6 | 117 |
| | 1C | 4.7 | 4.4 | 1.05 | 4.2 | 3.8 | 1.10 | 7.5 | 120 |
| 2 | 2Bk | 4.8 | 4.5 | 1.07 | 4.2 | 3.7 | 1.14 | 5.5 | 320 |
| | 2Y | 4.6 | 4.3 | 1.08 | 4.1 | 3.6 | 1.13 | 5.7 | 332 |
| | 2M | 4.8 | 4.4 | 1.09 | 4.1 | 3.7 | 1.11 | 5.8 | 295 |
| | 2C | 4.7 | 4.4 | 1.06 | 4.2 | 3.8 | 1.12 | 5.6 | 280 |
| 3 | 3Bk | 4.5 | 4.1 | 1.10 | 4.0 | 3.4 | 1.18 | 8.2 | 63 |
| | 3Y | 4.6 | 4.1 | 1.12 | 4.1 | 3.5 | 1.17 | 8.3 | 72 |
| | 3M | 4.6 | 4.1 | 1.12 | 4.2 | 3.6 | 1.18 | 8.1 | 56 |
| | 3C | 4.7 | 4.2 | 1.11 | 4.1 | 3.5 | 1.17 | 8.2 | 66 |
| 4 | 4Bk | 4.6 | 3.7 | 1.24 | 4.1 | 3.1 | 1.32 | 13.6 | 64 |
| | 4Y | 4.7 | 3.8 | 1.23 | 4.2 | 3.2 | 1.31 | 13.5 | 70 |
| | 4M | 4.6 | 3.8 | 1.22 | 4.1 | 3.1 | 1.32 | 13.6 | 75 |
| | 4C | 4.7 | 3.8 | 1.23 | 4.2 | 3.2 | 1.31 | 13.5 | 65 |
| 5 | 5Bk | 4.7 | 4.3 | 1.09 | 4.1 | 3.6 | 1.14 | 6.3 | 275 |
| | 5Y | 4.6 | 4.3 | 1.08 | 4.2 | 3.7 | 1.14 | 6.4 | 276 |
| | 5M | 4.8 | 4.4 | 1.10 | 4.1 | 3.7 | 1.12 | 6.5 | 273 |
| | 5C | 4.7 | 4.2 | 1.11 | 4.2 | 3.7 | 1.14 | 6.3 | 275 |
| 6 | 6Bk | 3.9 | 3.7 | 1.05 | 3.3 | 2.8 | 1.18 | 6.8 | 25 |
| | 6Y | 3.9 | 3.7 | 1.05 | 3.2 | 2.7 | 1.17 | 6.8 | 27 |
| | 6M | 4.0 | 3.8 | 1.04 | 3.2 | 2.7 | 1.18 | 6.9 | 24 |
| | 6C | 4.0 | 3.8 | 1.06 | 3.3 | 2.8 | 1.16 | 6.7 | 23 |
| 7 | 7Bk | 3.8 | 3.4 | 1.12 | 3.2 | 2.7 | 1.19 | 11.3 | 63 |
| | 7Y | 3.9 | 3.5 | 1.11 | 3.2 | 2.8 | 1.14 | 10.7 | 65 |
| | 7M | 3.8 | 3.4 | 1.12 | 3.2 | 2.7 | 1.19 | 10.9 | 67 |
| | 7C | 3.9 | 3.5 | 1.12 | 3.3 | 2.8 | 1.17 | 11.4 | 63 |
| 8 | 8Bk | 3.9 | 3.8 | 1.03 | 3.3 | 2.8 | 1.19 | 6.3 | 1.1 |
| | 8Y | 3.9 | 3.8 | 1.03 | 3.3 | 2.8 | 1.19 | 6.4 | 1.3 |
| | 8M | 3.8 | 3.7 | 1.03 | 3.2 | 2.7 | 1.17 | 6.5 | 1.6 |
| | 8C | 3.9 | 3.8 | 1.03 | 3.3 | 2.8 | 1.17 | 6.3 | 0.8 |
| 9 | 9Bk | 5.6 | 5.3 | 1.06 | 5.1 | 4.5 | 1.13 | 8.5 | 88 |
| | 9Y | 5.5 | 5.1 | 1.07 | 5.0 | 4.5 | 1.12 | 8.4 | 87 |
| | 9M | 5.6 | 5.3 | 1.06 | 5.1 | 4.6 | 1.12 | 8.3 | 86 |
| | 9C | 5.5 | 5.1 | 1.07 | 5.0 | 4.4 | 1.13 | 8.4 | 85 |
| 10 | 10Bk | 5.5 | 4.8 | 1.15 | 4.9 | 4.0 | 1.23 | 12.5 | 86 |
| | 10Y | 5.4 | 4.7 | 1.16 | 4.8 | 3.9 | 1.22 | 11.8 | 87 |
| | 10M | 5.5 | 4.8 | 1.15 | 4.9 | 3.8 | 1.29 | 12.8 | 88 |
| | 10C | 5.4 | 4.7 | 1.16 | 4.8 | 3.9 | 1.22 | 12.4 | 87 |
| 11 | 11Bk | 5.7 | 5.4 | 1.06 | 5.1 | 4.4 | 1.16 | 6.3 | 16 |
| | 11Y | 5.6 | 5.2 | 1.07 | 5.0 | 4.3 | 1.17 | 6.4 | 18 |
| | 11M | 5.8 | 5.4 | 1.07 | 5.2 | 4.4 | 1.18 | 6.3 | 17 |
| | 11C | 5.7 | 5.4 | 1.06 | 5.2 | 4.5 | 1.16 | 6.2 | 16 |
| 12 | 12Bk | 7.8 | 7.3 | 1.07 | 7.4 | 6.7 | 1.10 | 6.8 | 43 |
| | 12Y | 7.7 | 7.1 | 1.08 | 7.3 | 6.6 | 1.11 | 6.7 | 44 |
| | 12M | 7.6 | 7.1 | 1.07 | 7.2 | 6.4 | 1.12 | 6.8 | 46 |
| | 12C | 7.8 | 7.3 | 1.07 | 7.3 | 6.6 | 1.10 | 6.7 | 43 |

Manufacture of Photo Conductor

As conducting as follows, the photoreceptor used for Example was produced (the photoreceptor of each Example produced a total of four or more, in order that each image unit might use the photoreceptor of the same type).

Manufacture of Photo Conductor

The following intermediate layer coating solution was prepared, it was coated by the immersion coating method on the cleaned cylindrical alminum substrate, and the intermediate layer of 0.3 μm of dried coating layer thickness was formed.

| <Intermediate layer (UCL) coating solution> | |
|---|---|
| Polyamide resin (AMILAN CM-8000: made by Toray Industries, Inc.) | 60 g |
| Methanol | 1600 ml |

The following coating composition liquids were mixed and dispersed by means of sand mill for ten hours, thereby electric charge generating layer coating liquid was prepared. This coating liquid was applied by a dip coating method on the interlayer, thereby an electric charge generating layer of 0.2 μm dry film thickness was formed.

| <Electric charge generating layer (CGL) composition liquid> | |
|---|---|
| Y type titanyl phthalocyanine (the maximum peak angle of the X-ray diffractometry by Cu—K alpha characteristic X-rays 2θ was 27.3°) | 60 g |
| Silicone resin solution (KR5240, 15% xylene-butanol solution: made by a Shin-Etsu Chemical Co., Ltd. company) | 700 g |
| 2-butanone | 2000 Part |

The following coating composition liquids were mixed and dissolved, thereby an electric charge transporting layer coating liquid was prepared. The charge transporting layer of 20 μm of thickness of dried coating layer was formed with this coating solution by the immersion coating method on the above-mentioned charge generation layer.

| <Charge transport layer (CTL) composition liquid> | |
|---|---|
| Electric charge transportation material (4-methoxy--4'-(4-methyl-alpha-phenyl styryl) triphenylamine) | 200 g |
| Bisphenol Z type polycarbonate (EUPILON Z300: made by a Mitsubishi Gas Chemical Company INC. company) | 300 g |
| Hindered amine (SANOR LS2626: made by an SANKYO CO., LTD. company) | 3 g |
| 1,2-dichloroethane | 2000 ml |
| <Surface protecting layer> | |
| Electric charge transportation material (4-methoxy--4'-(4-methyl-alpha-phenyl styryl) triphenylamine) | 200 g |
| Bisphenol Z type polycarbonate (EUPILON Z300: made by a Mitsubishi Gas Chemical Company INC. company) | 300 g |
| Hindered amine (SANOR LS2626: made by an SANKYO CO., LTD. company) | 3 g |
| Polytetrafluoroethylene resin particles (average particle diameter of 0.5 μm) | 100 g |
| 2-butanone | 2000 Part |

The above-mentioned compositions were mixed and dissolved, thereby a charge transporting layer coating solution was prepared. This coating solution was coated by the immersion coating method on the above-mentioned charge transporting layer, and heating hardening were performed at 100° C. for 40 minutes, the surface protecting layer of 4 μm of dried coating layer thickness was formed, and thereby the photoreceptor was produced. The surface contact angle over the water of the photoreceptor was 106°.

<Evaluation>

As the photoreceptor and developing means of each image formation unit, the above-mentioned 4 photoreceptors and 4 sets of each developing means to contain developers (toner) of Y (yellow), M (magenta), C (cyan), and Bk (black) of every developer group (toner group) shown in Table 1 were combined, These photoreceptors and developing means were mounted in a digital process copying machine which has an intermediate transfer member shown in FIGS. 1–4. Under normal temperature/normal humidity (20° C., 50% RH), 10,000 A4 picture images which have a white area, a solid imaging area of Bk, Y, M and C, a character imaging area, and a halftone picture image as an original picture image were printed, and were evaluated. Evaluation criteria, a valuation method, and an evaluation basis are described below.

Character Image Scattering

A character picture image was formed, toner scattering around the periphery of character was observed with a visual observation and a 20 time magnifying glass, and evaluation was conducted on the following criteria.

A: Even magnifying glass observation, toner scattering was not observed around the periphery of the character (excellent).

B: Although it could not be discriminated visually, the toner scattering of around the periphery of character was observed with a magnifying glass. (it is no problem practically)

C: Toner scattering was visually observed around the periphery of the character and the sharpness of the character was inferior.

Imperfect Transfer

The halftone picture image of image density 0.4 was formed in both side surfaces of a transfer paper (basis-weight 200 g/m2), and the occurrence of white spot due to imperfect transfer was evaluated with the visual observation.

AA: There was no imperfect transfer (very excellent).

A: Per 100 picture images, although 1–2 imperfect transfers existed, if they were not gazed, they could not be discriminated (excellent).

B: Although 1–4 imperfect transfers per 50 picture images existed, if they were not gazed, they could not be discriminated (it is no problem practically).

C: Five or more clear imperfect transfers existed per 50 picture images regardless of front and back sides. Cleaning ability of an intermediate transfer member.

A: There was also no occurrence of coagulation, such as toner, on an intermediate transfer member, cleaning was excellent, and no occurrence of image unevenness was also observed (excellent).

B: Although occurrence of coagulation, such as toner, was slightly on an intermediate transfer member, cleaning was excellent and also no occurrence of image unevenness was observed (practically with no problem).

C: Occurrence of coagulation, such as toner, was observed on an intermediate transfer member, passing-through of toner occurred, and image unevenness has occurred.

Image Density

The image density of a solid portion of each color was measured using a densitometer "RD-918" (made in Macbeth), and the image density was measured as a relative reflection density in which the image density of a recording sheet was set to zero.

A: Each optical density of the solid imaging area of Bk, and Y, M and C is 1.2 or more. (excellent)

B: Each optical density of the solid imaging area of Bk, and Y, M and C is 0.8 or more. (practically with no problem)

C: Each optical density of the solid imaging area of Bk, and Y, M and C is less than 0.8.

(Sharpness)

An image was formed in both the circumstances of low temperature and low humidity (10° C. 20% RH) and high temperature and high humidity (30° C. 80% RH), and the sharpness of the image was evaluated with character collapse. Character images of 3 points and 5 points were formed, the character images evaluated with the following judgment criteria.

A: both of the 3 points and 5 point were clear and decipherable easily.

B: 3 points partially was not decipherable, 6 points were clear and decipherable easily.

C: 3 points was almost not decipherable and also 5 points partially or almost was not decipherable.

Process Condition of a Digital Process Copying Machine Having an Intermediate Transfer Member Line speed L/S of image formation: 180 mm/s An electrostatic charge condition of photoreceptor (40 mmϕ): Potential of non-image section was detected with potential sensor, and a feed back control was conducted in such a manner that a control range was −500V to −900V and the surface potential of photo conductor was controlled within a range of −50 to 0 V when an entire exposure was conducted.

Image exposure light: semiconductor laser (wavelength: 780 nm)

Intermediate transfer member: a seamless endless belt-shaped intermediate transfer member 70 was used, and the belt was made of a semi conductive resin having a volume resistance ratio of $1\times10^8$ Ω/cm and Rz of 0.9 μm.

Primary Transfer Condition

A primary transfer roller (5Y, 5M, 5C, 5BK of FIG. 1 (each 6.05 mmϕ)): the structure in which a metal core was provided with elastic gum: Surface specific resistance $1\times10^6$ Ω, a transfer voltage was applied.

A Secondary Transfer Condition

A back-up roller 74 and a secondary transfer roller 5A were disposed to put endless belt-shaped intermediate transfer body 70 as the intermediate transfer body therebetween, the resistance value of the back-up roller 74 was $1\times10^6$ Ω, the resistance value of the secondary transfer roller as a secondary transfer means was $1\times10^6$ Ω, a constant current control (about 80 μA) was conducted.

Fixing is a heat fixing method by a fixing roller in which a heater was arranged in a roller interior.

A distance Y on an intermediate transfer body from the first contact point between the intermediate transfer body and a photo conductor to the first contact point between the intermediate transfer body and a photo conductor for a next color was 95 mm.

The outer circumferential length (circumferential length) of drive roller 71, guide roller 72,73 and back-up roller 74 for use in secondary transfer is made 31.67 mm (=95 mm/3), and the outer circumferential length of tension roller 76 was made 23.75 mm (=95 mm/4).

And, the outer circumferential length of a primary transfer roller was made 19 mm (=95 mm/5).

Cleaning Condition for Photoreceptor

Cleaning blade: The urethane rubber blade (8 mm of free length) of 65 JISA hardness and rebound resilience 60 was brought in contact by the counter method to the rotation direction of the photoreceptor with the contact weight of 18 N/m.

Cleaning condition for an intermediate transfer member The cleaning means indicated in FIG. 2 was used as the cleaning means 6A.

Elastic blade 61A: The urethane rubber of a hardness of rubber 75 and the rebound resilience 35 in 23 C was used. The thickness of the elastic blade 61A was 2 mm, the free length of it was 10 mm, the blade was supported by a supporting member (rocking arm 61D+holder 61F), the blade was brought in contact with a counter method in a intermediate transfer member moving direction, and the angle with the drive belt-like intermediate transfer member 70 was made to be an angle 16.5. The amount of intrusion of the leading-end of elastic blade 61A to the drive belt-like intermediate transfer member 70 was set to 1.25 mm.

Metal scraper 61B: SUS304 whose leading-end was subjected to an etching process was used. The thickness of the metal scraper 61B was 0.15 mm, the free length of it was 10 mm, the scraper was supported by a supporting member (rocking arm 61D+holder 61F), the scraper was brought in contact with a counter method in a intermediate transfer member moving direction, and the angle with the drive belt-like intermediate transfer member 70 was made to be an angle 16.5. The amount of intrusion of the leading-end of Metal scraper 61B to the drive belt-like intermediate transfer member 70 was set to 1.00 mm. Moreover, the interval d of the elastic blade 61A at the upstream side and the metal scraper 61B of an at the downstream-side was set as 2 mm.

The results are shown in Table 2.

TABLE 2

| Developing agent group (Toner group) No. | Character image scattering | Transfer omission | Cleaning ability of intermediate transfer member | Image density | Sharpness | Remarks |
|---|---|---|---|---|---|---|
| 1 | A | A | A | A | A | Inv. |
| 2 | C | B | C | B | C | Com. |
| 3 | A | A | B | A | A | Inv. |
| 4 | C | C | C | B | C | Com. |
| 5 | A | A | A | A | A | Inv. |
| 6 | A | A | A | A | A | Inv. |
| 7 | C | B | B | B | C | Com. |
| 8 | A | A | A | A | A | Inv. |
| 9 | A | A | B | A | A | Inv. |
| 10 | C | B | C | B | C | Com. |
| 11 | A | A | A | A | A | Inv. |
| 12 | A | A | A | A | A | Inv. |

From Table 2, in developer groups (No.1, 3, 5, 6, 8, 9, 11, 12) in which the amount of remaining monomers of each color toner used for the developing means of each image formation unit is 300 ppm or less, and the content of toner particles whose particle diameters were below 0.7×(Dp50) was ten number % or less, character image scattering, an imperfect transfer, the cleaning ability of an intermediate transfer member, an image density, and sharpness have attained the excellent evaluation more than the practical use range. In contrast, in the other developer group (No.2), since the amount of remaining monomers remains so much, character image scattering occurs, the cleaning ability of an intermediate transfer member also deteriorates, and sharpness was falling. Moreover, in the developer groups (No.4, 7, 10) containing toner particles in which the content of the toner particles whose particle diameters are below 0.7×(Dp50) is larger than 10 number %, character image scattering, an imperfect transfer, and the cleaning ability of an intermediate transfer member deteriorated, and sharpness was falling in developer group No.4, character image scattering deteriorated in No.7, character image scattering and the cleaning ability of an intermediate transfer member deteriorated in No.10, and sharpness was falling in Nos. 7 and 10.

Example 2

Alternation of the Cleaning Means of an Intermediate Transfer Member

Evaluation of the developer groups 3 and 9 of the above-mentioned Example 1 was evaluated on the condition that the metal scraper of the cleaning means of an intermediate transfer member was removed. The evaluation items, the evaluation method, and the evaluation criteria were also made to be the same as that of Example 1.

Further, evaluation results are shown in Table 2.

TABLE 3

| Developing agent group (Toner group) No. | Character image scattering | Transfer omission | Cleaning ability of intermediate transfer member | Image density | Sharpness |
|---|---|---|---|---|---|
| 3 | B | B | C | A | C |
| 9 | A | B | C | A | C |

From the result of Table 3, in comparison with Example 1, evaluation result was found to be lowered.

In particular, fall-off of the cleaning ability of an intermediate transfer member and deterioration of the sharpness accompanying with this becomes greatly. Namely, it is found that on the condition that the metal scraper is removed from the cleaning means of an intermediate transfer member, even if the developer group within the limits of the present invention is used, the cleaning ability of an intermediate transfer member falls off and sufficient picture image performance is not obtained.

What is claimed is:

1. An image forming apparatus, comprising:

a plurality of image forming units each having an electrophotographic photoreceptor, a charging device, an exposing device, a developing device, a transferring device, and a cleaning device, an intermediate transfer member, and an intermediate transfer member cleaning device to remove toner remaining the intermediate transfer member with plural cleaning blades, wherein a color toner image is formed in such a way that each color toner image formed on each electrophotographic photoreceptor with toner whose color is changed for each of the plurality of image forming units is sequentially transferred and superimposed on the intermediate transfer member, the color toner image is retransferred at one time onto a recording material and the retransferred color toner image is fixed so as to form a color image, and wherein each color toner used in the respective developing device of the plurality of image forming units contains 10 number % or less of toner particles whose diameter is (0.7×50% number particle diameter (Dp50)) or less and contains 300 ppm or less of a remaining monomers.

2. The image forming apparatus of claim 1, wherein each color toner has a ratio (Dv50/Dp50) of a cumulative 50% volume particle diameter (Dv50) on the basis of volume to a cumulative 50% number particle diameter (Dp50) on the basis of number being 1.0 to 1.15 and a ratio (Dv75/Dp75) of a cumulative 75% volume particle diameter (Dv75) from the largest particle diameter on the basis of volume to a cumulative 75% number particle diameter (Dp75) from the largest particle diameter on the basis of number being 1.0 to 1.20.

3. The image forming apparatus of claim 1, wherein the plurality of image forming units have 4 sets of image forming units consisting of an image forming unit having black toner, an image forming unit having yellow toner, an image forming unit having magenta toner, and an image forming unit having cyan toner.

4. The image forming apparatus of claim 3, wherein the black toner, the yellow toner, the magenta toner and the cyan toner are polymerized toner.

5. The image forming apparatus of claim 3, wherein the black toner has 50% volume particle diameter (Dv50) of 3.0 to 8.0 μm.

6. The image forming apparatus of claim 1, wherein the black toner is polymerized toner.

7. The image forming apparatus of claim 1, wherein at least one cleaning blade of the plural cleaning blades is a non-deformable member.

8. The image forming apparatus of claim 7, wherein the non-deformable member is structured with a metal scraper.

9. The image forming apparatus of claim 1, wherein at least one cleaning blade of the plural cleaning blades is an elastic blade.

10. The image forming apparatus of claim 9, wherein the elastic blade is a urethane rubber blade.

11. The image forming apparatus of claim 1, wherein a contact angle for a water of a surface of the each electrophotographic photoreceptor is 90° or more.

12. The image forming apparatus of claim 1, wherein a surface layer of the each electrophotographic photoreceptor contains fluoro resin particles.

13. The image forming apparatus of claim 1, wherein the amount of remaining monomers is 50 ppm or less.

14. The image forming apparatus of claim 1, wherein the ten point surface roughness Rz of the intermediate transfer member is 0.5 to 2 μm.

15. The image forming apparatus of claim 1, wherein each surface layers of the each electrophotographic photoreceptor contain an oxidization prevention agent.

16. The image forming apparatus of claim 1, wherein the intermediate transfer member is a belt-shaped intermediate transfer member.

17. An image forming method, comprising the steps of:

forming a color toner image in such a way that each color toner image formed on each electrophotographic photoreceptor with toner whose color is changed for each of the plurality of image forming units is sequentially transferred and superimposed on the intermediate transfer member, wherein each color toner contains 10 number % or less of toner particles whose diameter is (0.7×50% number particle diameter (Dp50)) or less and contains 300 ppm or less of a remaining monomers;

transferring the color toner image at one time onto a recording material;

fixing the retransferred color toner image on the recording material so as to form a color image, and removing toner remaining the intermediate transfer member with plural cleaning blades of an intermediate transfer member cleaning device.

18. An image forming method of claim 17, wherein each color toner has a ratio (Dv50/Dp50) of toner particles of 50% volume particle diameter (Dv50) on a basis of volume to 50% number particle diameter (Dp50) on a basis of number being 1.0–1.15, and a ratio (Dv75/Dp75) of a cumulative 75% volume particle diameter (Dv75) from the largest particle diameter to a cumulative 75% number particle diameter (Dp75) from the largest particle diameter being 1.0 to 1.20.

19. The image forming method of claim 17, wherein at least one cleaning blade of the plural cleaning blades is a non-deformable member and at least one cleaning blade of the plural cleaning blades is an elastic blade.

20. The image forming method of claim 19, wherein the each electrophotographic photoreceptor is cleaned with an elastic blade.

* * * * *